US005996205A

United States Patent [19]

Mashiko et al.

[11] Patent Number: 5,996,205

[45] Date of Patent: Dec. 7, 1999

[54] METHOD FOR MANUFACTURING A PIPE WITH A PARTITION

[75] Inventors: Seiji Mashiko; Michito Saito, both of Tokyo, Japan

[73] Assignee: Calsonic Corporation, Tokyo, Japan

[21] Appl. No.: 09/095,647

[22] Filed: Jun. 11, 1998

[30] Foreign Application Priority Data

| | | | |
|---|---|---|---|
| Jun. 11, 1997 | [JP] | Japan | 9-153394 |
| Jun. 26, 1997 | [JP] | Japan | 9-170318 |
| Mar. 3, 1998 | [JP] | Japan | 10-050535 |

[51] Int. Cl.[6] ..... B21D 39/02

[52] U.S. Cl. ..... 29/463; 29/890.03

[58] Field of Search ..... 29/463, 890.052, 29/890.053, 890.03; 72/379.6, 379.2, 381; 100/137, 193

[56] References Cited

U.S. PATENT DOCUMENTS 4,860,570 8/1989 Perrault et al. ..... 72/379

FOREIGN PATENT DOCUMENTS 0 761 337 3/1997 European Pat. Off. ..... B21D 53/04

OTHER PUBLICATIONS

Patent Abstracts of Japan vol. 96, No. 4, Apr. 30, 1996 & JP 07 314 035 A (Calsonic Corp) Dec. 5, 1995 *Abstract.

*Primary Examiner*—P. W. Echols
*Assistant Examiner*—John C. Hong
*Attorney, Agent, or Firm*—Sughrue, Mion, Zinn, Macpeak & Seas, PLLC

[57] ABSTRACT

In the method for manufacturing a pipe with a partition, a flat plate is molded such that a pair of semidivided cylindrical portions are arranged in parallel to each other through a connecting portion, a U-shaped partition forming portion is so formed in the pair of semidivided cylindrical portions as to project inwardly thereof, and the partition forming portion is compressed from the two sides thereof to thereby form a semidivided partition portion. The connecting portion situated between the partition forming portion is cut to thereby form an escape hole. The escape hole is formed of not only by first and second lateral-direction lines opposed to each other with a gap between them and crossing the connecting portions but also by first and second longitudinal-direction lines connecting together the end points of the first and second lateral-direction lines on the same side thereof, and the distance between the first and second longitudinal-direction lines decreases as they approach the centers of the longitudinal-direction lines. Further, the compression of the U-shaped partition forming portion is carried out in such a manner that the compression and deformation amounts of the other portions of the U-shaped partition forming portion than the leading end portion thereof are larger than that of the leading end portion.

12 Claims, 21 Drawing Sheets

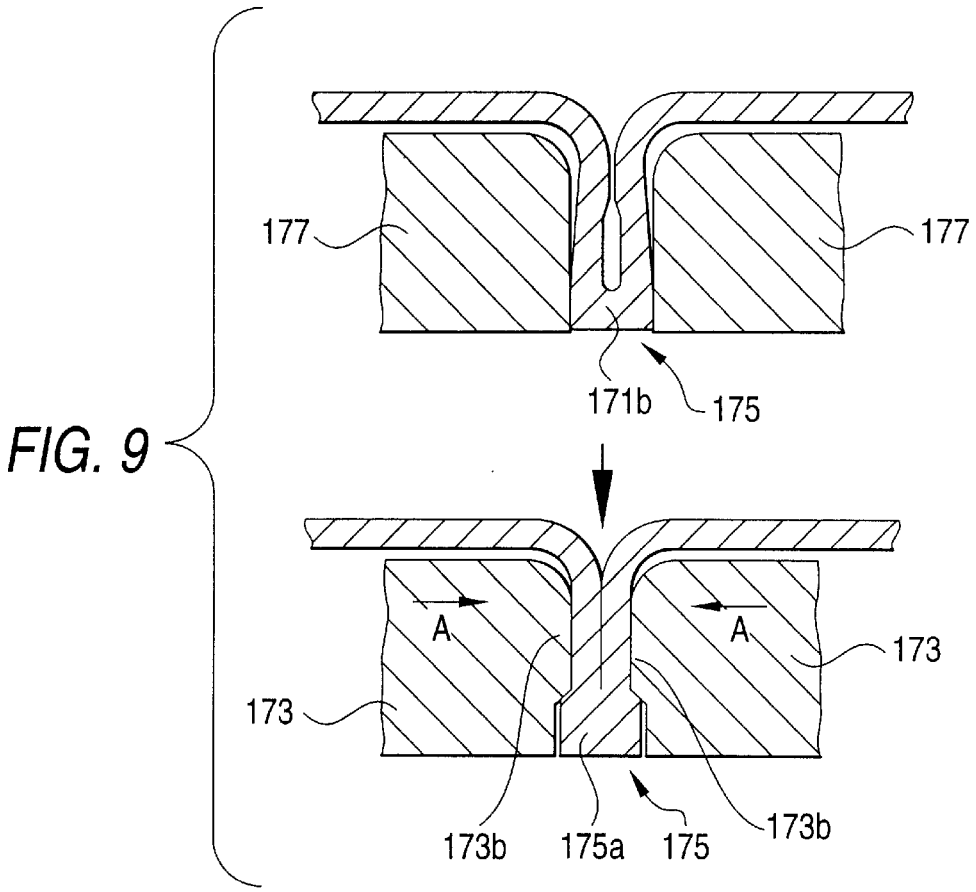
FIG. 9
FIG. 10
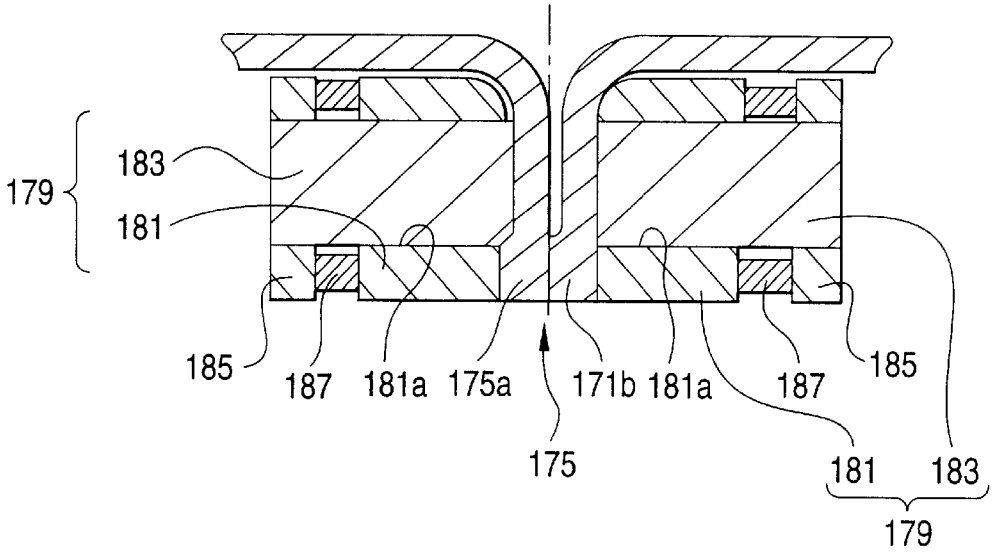

METHOD FOR MANUFACTURING A PIPE WITH A PARTITION

BACKGROUND OF THE INVENTION

1. Field of the Invention

The present invention relates to a method for manufacturing a pipe with a partition in such a manner that a partition portion is formed integrally with the middle portion of the pipe.

2. Description of the Related Art

Conventionally, in a heat exchanger such as a capacitor for use in a car or the like, for example, as disclosed in Japanese Utility Model Publication No. Hei. 4-63992, a partition is provided in a header to thereby change a fluid flow passage.

And, conventionally, this type of header with a partition for use in a heat exchanger is manufactured in the following manner as shown in FIG. 25.

At first, an aluminum alloy pipe member with a brazing member clad on the outer surface thereof is cut to a given size to thereby obtain a pipe 11 which can be used in a header.

After then, in the pipe 11, there are formed a tube insertion hole 13, a slit for a divide 15, a fluid flow-in port 17, and a fluid flow-out port 19.

Next, an aluminum alloy divide 21 with brazing members clad on the two surfaces thereof is inserted into the slit for a divide 15, and also two aluminum alloy patches 23 are respectively pressure inserted into the two ends of the pipe 11 so as to manufacture a header pipe.

However, in the thus structured header with a partition for use in a heat exchanger, since there is used an expensive pipe member which has been previously formed in a cylindrical shape, the material cost thereof increases.

Also, there is a fear that a poor brazed condition can occur between the pipe 11 and divide 21.

Conventionally, as a method which has solved these problems, there is known a method for manufacturing a pipe with a partition which is disclosed in Japanese Patent Publication No. Hei. 7-314035.

In this method for manufacturing a pipe with a partition, as shown in FIGS. 26 and 27, there is manufactured a pipe with a partition structured such that a partition portion 33 comprising of a pair of semidivided partition portions 32 is formed in the central portion of a cylindrical-shaped pipe portion 31 thereof.

And, the present pipe with a partition can be manufactured in the following manners:

That is, at first, in a molding step shown in FIG. 28, a plate member formed of aluminum is molded in such a manner that a pair of semidivided cylindrical portions 35 are formed.

The pair of semidivided cylindrical portions 35 are arranged in parallel to each other with an arc-shaped connecting portion 37 between them.

And, each of the paired semidivided cylindrical portions 35 includes a partition forming portion 39 which projects inwardly in a U-shape manner.

Also, each of the paired semidivided cylindrical portions 35 is smaller by 2 mm or so in radius than a pipe portion 31 to be formed, while each semidivided cylindrical portion 35 further includes an edge portion 41 on the outside thereof.

The above-mentioned molding step is carried out by holding a flat plate between a given pair of metal molds and press working the flat plate.

Next, in a cutting step shown in FIG. 29, a portion of the connecting portion 37 situated between the partition forming portions 39, that is, an escape hole 37*a*, as well as the edge portions 41 respectively situated on the two sides of the partition portions 39 are cut and removed together with the excessively increased thickness portions 41*a* of the edge portions 41.

This cutting step is executed by trimming and piercing the press worked plate using a press work machinery.

Then, in a compressing step shown in FIG. 30, the partition forming portion 39 is compressed from both sides thereof in a direction of an arrow a in FIG. 30 to thereby form a semidivided partition portion 32.

This compressing step is carried out in such a manner as shown in FIG. 31: that is, the outsides of the semidivided cylindrical portions 35 are respectively held by a work holder 51 which is energized by springs 49 and, on the other hand, two compressing members 53 are respectively disposed on the two sides of the partition forming portion 39 located inwardly of the semidivided cylindrical portions 35, whereby the partition forming portion 39 is compressed and molded by the compressing members 53.

In this compression molding operation, between the compressing members 53, there is interposed a dimension correcting block 55; that is, the inwardly projecting length H of the semidivided partition portion 32 can be corrected by the dimension correcting block 55.

Next, in an edge portion molding step shown in FIG. 32, the two edge portions 41 on the two sides of the pair of semidivided cylindrical portions 35 are molded and, as shown in a lower side in FIG. 32, the edge portions 41 are formed in an arc-shaped manner; that is, the edge portions 41 are so formed as to continue with their respective semidivided cylindrical portions 35 in an arc-shape manner.

This edge portion molding, step is carried out by holding a pair of semidivided cylindrical portions 35 between a given metal molds and then press working them.

Then, in a mutually opposing stop shown in FIG. 33, the connecting portion 37 is projected from the inside thereof to thereby allow the pair of semidivided cylindrical portions 35 to be disposed in such a manner that they are opposed to each other.

In particular, this mutually opposing step is carried out by storing the outsides of the semidivided cylindrical portions 35 into a metal mold 57 and then pressing the connecting portion 37 against the arc portion 61 of the metal mold 57 by a punch 59.

Next, in a butting step shown in FIG. 34, the pair of mutually opposed semidivided cylindrical portions 35 are butted against each other.

This butting step is carried out by storing the outsides of the semidivided cylindrical portions 35 into a metal mold (not shown) and then moving the metal mold. In this step, the semidivided cylindrical portions 35 are molded into a pipe shape.

After then, a connecting step is carried out; that is, not only the pair of semidivided cylindrical portions 35 but also the pair of semidivided partition portions are connected to each other, thereby manufacturing a pipe with a partition which is shown in FIGS. 26 and 27.

The connecting step can be achieved, for example, by executing a brazing operation using non-corrosive flux.

Now, FIG. 35 shows a header with a partition for use in a heat exchanger manufactured in the above-mentioned partitioned pipe manufacturing method; and, the present header with a partition for a heat exchanger includes a partition portion 33 formed in the central portion of a cylindrically-shaped pipe portion 31A thereof.

Also, on one side of the outer periphery of the pipe portion 31A, there are formed tube insertion holes 63 which are spaced from each other at given intervals.

Further, the openings of the pipe portion 31A, which are respectively formed in the two ends of the pipe portion 31A, are closed by cover members 65 respectively.

In the present method for manufacturing a header with a partition for a heat exchanger, after completion of the edge portion molding step shown in FIG. 32, as shown in FIG. 36, the tube insertion holes 63 are formed in one of the semidivided cylindrical portions 35 at given intervals and, at the same time, there are formed a fluid flow-in port 67, into which a thermal medium is allowed to flow, and a fluid flow-out portion 69 from which the thermal medium is allowed to flow out.

This step can be carried out by alit-pierce molding the semidivided cylindrical portion 35 using a press work machinery.

In the thus manufactured header with a partition for a heat exchanger, since a single piece of plate member can be molded easily into a pipe portion 31A having a partition portion 33 formed integrally therewith, there is eliminated the need for use of an expensive pipe member which has been previously formed into a cylindrical shape. This makes it possible to reduce the material cost thereof greatly when compared with the former conventional header.

Also, with use of the present header with a partition for a heat exchanger, when compared with the method in which a pipe is manufactured in a cylindrical shape, since the partition portion thereof is formed integrally with the pipe portion thereof, the number of parts used can be decreased to thereby be able to reduce the cost of the header.

Further, because the tube insertion hole 63 can be worked in a semicircle condition, a mold used to mold the tube insertion hole 63 can be made sufficiently strong, the working time of the tube insertion holes 63 can be shortened, and thus the cost of the header can also be reduced.

However, in the above-mentioned conventional method for manufacturing a pipe with a partition, when the pair of mutually opposed semidivided cylindrical portions 35 are butted against each other to thereby form a pipe shape according to the butting step shown in FIG. 34, actually, as shown in FIG. 37, there is raised a problem that a relatively large gap S is produced between the semidivided partition portion 32 and connecting portion 37.

Such gap S is produced because, in the cutting step shown in FIG. 29, the connecting portion 37 situated between the partition forming portions 39 is cut into a rectangular shape to thereby form the rectangular-shaped escape hole 37*a*.

That is, if the escape hole 37*a* is formed in a rectangular shape, after completion of the edge portion molding step following the compressing step shown in FIG. 30, it is assumed that, as shown by dotted lines in FIG. 38, the edge portions of the semidivided partition portions 32 on the connecting portion 37 side thereof are parallel to the center lines of the semidivided cylindrical portions 35.

However, in fact, in the molding step shown in FIG. 28, the reduction of the plate thickness of the partition forming portion 39 on the connecting portion 37 side thereof is smaller than the remaining portions of the partition forming portion 39 and, for this reason, if the partition forming portion 39 is pressed to thereby form the semidivided partition portion 32 according to the compressing step shown in FIG. 30, then the larger plate thickness portions of the partition forming portion 39 on the connecting portion 37 side thereof, as shown in FIG. 38, are caused to project toward the connecting portion 37 side in a trapezoidal manner, so that there are produced projecting portions 32*a*.

And, if the projecting portions 32*a* are produced in this manner, then, in the butting step shown in FIG. 34, it is difficult to form the connecting portion 37 in an arc shape and, as shown in FIG. 31, there is formed a relatively large gap S between the semidivided partition portion 32 and connecting portion 37.

By the way, on the opposite side of the semidivided partition portions 32 to the projecting portions 32*a*, there are formed portions 32*b* which are parallel to the center line of the semidivided cylindrical portions 35. However, in the butting step shown in FIG. 34, since the edge portions 35*a* of the semidivided cylindrical portions 35*a* are deformed and are thereby contacted closely with the portions 32*b*, there is no possibility that a large gap can be formed in the portions 32*b*.

Further, according to the above-mentioned conventional partitioned pipe manufacturing method, in the compressing step shown in FIG. 30, as shown in FIG. 39, if the pair of compressing members 53 are pressed against the partition forming portion 39 from the two sides thereof to compress the partition forming portion 39 to thereby form the semidivided partition portion 32, then there is produced a minute gap C1, for example, of the order of 0.05 mm on the outside of the semidivided partition portion 32 and, between the minute gap C1 and the leading end portion 32*c* of the semidivided partition portion 32, there is produced a relatively large gap C2 of the order of 0.3 mm; that is, there is a fear that, if liquid collects in the gap C2, then the gap C2 portion can be caused to corrode.

It has been found that the cause of production of the gaps C1 and C2; that is, the cause is that, in the molding step shown in FIG. 28, the root portion of the partition forming portion 39 becomes thin in thickness, whereas the leading end portion of the partition forming portion 39 becomes thick in thickness.

SUMMARY OF THE INVENTION

The present invention is made based on the above knowledge and, accordingly, it is an object of the invention to provide a method for manufacturing a pipe with a partition which is able to greatly reduce a gap formed between a semidivided partition portion and a connecting portion as well as being surely able to prevent such gap from being produced in the semidivided partition portion of the pipe as compared with the previously cited conventional methods.

According to a first aspect of the present invention, there is provided a method for manufacturing a pipe with a partition, comprising the steps of: molding a flat plate so that a pair of semidivided cylindrical portions are arranged in parallel to each other through a connecting portion and a pair of U-shaped partition forming portions are respectively so formed in the pair of semidivided cylindrical portions so as to project inwardly thereof; cutting at least a part of the connecting portion situated between the partition forming portions to thereby form an escape hole of which shape is defined by first and second lateral-direction lines opposed to each other with a gap between them and crossing the connecting portions and first and second longitudinal-direction lines connecting together end points of the first and second lateral-direction lines on the same side thereof, and the distance between the first and second longitudinal-direction lines decreases toward centers of the longitudinal-direction lines; compressing the partition forming portions respectively from both sides thereof to thereby form semidivided partition portions; projecting the connecting portion to thereby dispose the semidivided cylindrical portions so that they are opposed to each other; butting the mutually opposed, semidivided cylindrical portions against each other; and connecting the semidivided cylindrical portions to each other so as to manufacture a pipe with a partition.

The shape of an escape hole formed in the cutting step is defined not only by the first and second lateral-direction lines opposed to each other with a gap between them and crossing the connecting portions but also by the first and second longitudinal-direction lines connecting together the end points of the first and second lateral-direction lines on the same side thereof. Also, the distance between the first and second longitudinal-direction lines decreases toward the centers of the longitudinal-direction lines.

And, when the semidivided partition portions are formed according to the compressing step, then the edge portions of the semidivided partition portions on the connecting portion side thereof are formed in such a manner that they are inclined from the leading ends thereof toward the semidivided cylindrical portions. Due to this, in the butting step of the semidivided cylindrical portions, the connecting portion can be formed along the edge portions of the semidivided partition portions on the connecting portion side thereof.

In the above method for manufacturing a pipe with a partition, the first and second lateral-direction lines are preferably formed extending at right angles to a longitudinal direction of the connecting portion.

The first and second lateral-direction lines are set in such a manner that they extend at right angles to the longitudinal direction of the connecting portion.

And, when the semidivided partition portions are formed according to the compressing step, then the first and second lateral-direction lines are situated in such a manner they overlap each other.

Further, the first and second longitudinal-direction lines can be symmetrically formed on two sides of a longitudinal-direction center line of the connecting portion.

The first and second lateral-direction lines are formed symmetrically on the two sides of the longitudinal-direction center line of the connecting portion.

And, when the semidivided partition portions are formed according to the compressing step, the first and second longitudinal-direction lines are situated in such a manner they overlap each other.

Still further, at least one of the first and second longitudinal-direction lines may be formed in an arc shape having the same radius as an inner peripheral radius of the semidivided cylindrical portions.

Each of the longitudinal-direction lines is formed in an arc shape having the same radius as the inner peripheral radius of the semidivided cylindrical portion. And, when the semidivided partition portions are formed according to the compressing step, each of the edge portions of the semidivided partition portions on the connecting portion side thereof is formed as an arc shape which is inclined from the leading end thereof toward the semidivided cylindrical portion. Due to this, in the butting step of the semidivided cylindrical portions, the connecting portion having the same radius as the semidivided cylindrical portion can be formed along the edge portions of the semidivided partition portions on the connecting portion side thereof.

According to a second aspect of the present invention, there is provided a method for manufacturing a pipe with a partition, comprising the steps of: molding a flat plate so that a pair of semidivided cylindrical portions are arranged in parallel to each other through a connecting portion and a pair of U-shaped partition forming portions are respectively so formed in the pair of semidivided cylindrical portions so as to project inwardly thereof; compressing the partition forming portions respectively from both sides thereof so that compression and deformation amounts of the other portions of the partition forming portion than a leading end portion thereof are larger than that of the leading end portion, to thereby form semidivided partition portions; projecting the connecting portion to thereby dispose the semidivided cylindrical portions so that they are opposed to each other; butting the mutually opposed, semidivided cylindrical portions against each other;,and connecting the semidivided cylindrical portions to each other so as to manufacture a pipe with a partition.

In the above method, the compression of the U-shaped partition forming portion in the compressing step is carried out in such a manner that the compression and deformation amounts of the other portions of the U-shaped partition forming portion than the leading end portion thereof are larger than that of the leading end portion. Due to this, a gap, which is produced in the other portions of the semidivided partition portion than the leading end portion thereof, can be narrowed and closely contacted.

Further, in the manufacturing a pipe with a partition compressing step is carried out by disposing a pair of compressing members respectively on two sides of the partition forming portion, each of the pair of compressing members including, in a portion thereof where the leading end portion of the partition forming portion is not situated, a projecting portion projecting toward the partition forming portion; and pressing the pair of compressing members against the partition forming portions.

Each of the pair of compressing members includes, in the portion thereof where the leading end portion of the partition forming portion is not situated, a projecting portion which project toward the partition forming portion. Due to the projecting portions, a gap, which is produced in the other portions of the semidivided partition portion than the leading end portion thereof, can be narrowed and closely contacted.

Still further, the compressing step can be carried out by firstly compressing the leading end portion of the partition forming portion; and compressing the other portions of the partition forming portion than the leading end portion.

The compression of the U-shaped partition forming portion in the compressing step is carried out in such a manner that the leading end portion of the partition forming portion is firstly compressed and, after then, the other portions of the partition forming portion than the leading end portion thereof are compressed.

According to a third aspect of the present invention, there is provided a method for manufacturing a pipe with a partition, comprising the steps oft molding a flat plate so that a pair of semidivided cylindrical portions are arranged in parallel to each other through a connecting portion and a pair of U-shaped partition forming portions are respectively so formed in the pair of semidivided cylindrical portions so as to project inwardly thereof; firstly compressing whole of the partition forming portions respectively from both sides thereof; compressing a base portion of the partition forming portion from both sides thereof to thereby form semidivided partition portions; projecting the connecting portion to thereby dispose the semidivided cylindrical portions so that they are opposed to each other; butting the mutually opposed, semidivided cylindrical portions against each other; and connecting the semidivided cylindrical portions to each other so as to manufacture a pipe with a partition.

The compression of the -U-shaped partition forming portion in the compressing step is carried out in such a manner that the whole of the partition forming portion is firstly pressed and, after then, only the root portion of the partition forming portion is compressed. Due to this, a gap, which is produced in the root portion of the semidivided partition portion, can be narrowed and closely connected.

BRIEF DESCRIPTION OF THE DRAWINGS

In the accompanying drawings:

FIG. 9 is an explanatory view of another embodiment of a compressing step employed in a method for manufacturing a pipe with a partition according to the invention;

FIG. 10 is an explanatory view of still another embodiment of a compressing step employed in a method for manufacturing a pipe with a partition according to the invention;

DETAILED DESCRIPTION OF THE PREFERRED EMBODIMENTS

Now, description will be given below of the preferred embodiments of a method for manufacturing a pipe with a partition according to the invention with reference to the accompanying drawings.

Figure 1:
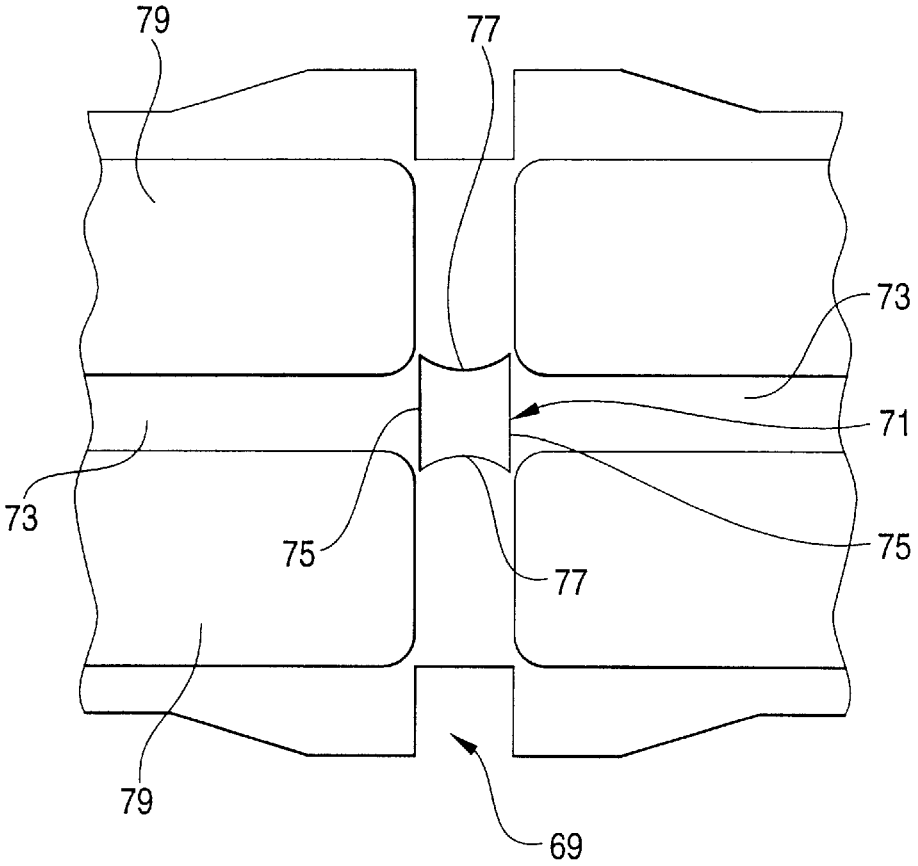
FIG. 1 is an explanatory view of an embodiment of a method for manufacturing a pipe with a partition according to the invention, showing a state of part of such pipe after a cutting step is carried out.

FIG. 1 is an explanatory view of an embodiment of a method for manufacturing a pipe with a partition according to the invention, showing a state thereof obtained after a cutting step thereof is executed. In this embodiment, the shape of an escape hole 71 formed in a partition forming portion 69 in the cutting step is defined not only by a pair of vertical lines 75 extending at right angles to the longitudinal direction of two mutually opposed connecting portions 73 with a gap between them but also by a pair of longitudinal-direction lines 75 connecting together the end points of the pair of vertical lines 75 on the same side thereof.

Figure 2:
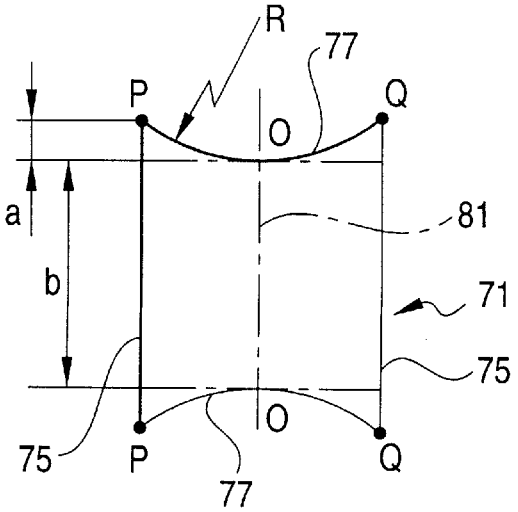
FIG. 2 is an explanatory view of an escape hole formed according to the cutting step shown in FIG. 1.

Also, as shown in FIG. 2, each of the longitudinal-direction lines 77 is formed in an arc shape having the same radius R as the inner peripheral radius R of a semidivided cylindrical portion 79, while a distance between the pair of longitudinal-direction lines 77 decreases as it approaches the middle points O of the longitudinal-direction lines 77.

Figure 3:
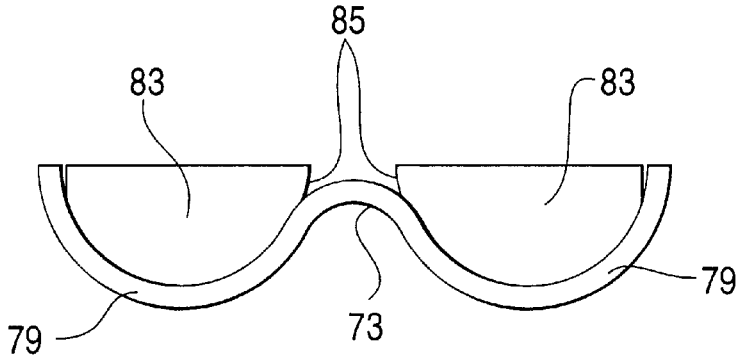
FIG. 3 is an explanatory view of semidivided partition portions formed by a compressing step employed in the embodiment of a method for manufacturing a pipe with a partition according to the invention.

And, after the escape hole 71 having the above shape is formed, if a compressing step is carried out, then the escape hole 71 is bent symmetrically with respect to a median line 81 obtained by connecting together the two middle points 0 of the longitudinal-direction lines 77 of the escape hole 71, thereby producing such semidivided partition portions 83 as shown in FIG. 3.

Figure 4:
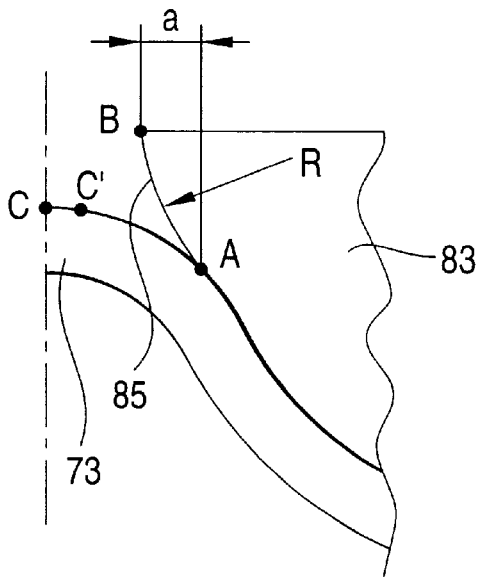
FIG. 4 is an explanatory view of the semidivided partition portion, in which the portion of the semidivided partition portion existing on the connecting portion side thereof is shown in an enlarged manner.

The edge portion of each of the semidivided partition portions 83 on the connecting portion 73 side thereof, as shown in an enlarged manner in FIG. 4, provides an arc-shaped portion 85 which is inclined in an arc manner from the leading end thereof toward the semidivided cylindrical portion 79.

Figure 5:
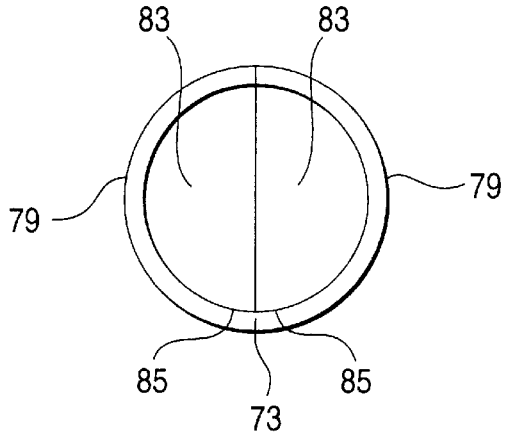
FIG. 5 is an explanatory view of the embodiment of a method for manufacturing a pipe with a partition according to the invention, showing a state of part of such pipe after a butting step is carried out.

After then, a mutually opposing step is carried out and, in a butting step which is carried out after completion of the mutually opposing step, as shown in FIG. 5, a connecting portion 73 having the same radius as the semidivided cylindrical portion 79 is formed along the arc-shaped portions 85 of the semidivided partition portions 83 on the connecting portion 73 sides thereof.

By the way, in the present embodiment, as shown in FIG. 4, the length AB of the arc of the arc-shaped portion 85 is so set as to have the same dimension AC' as the length dimension of the arc AC of the connecting portion 73 obtained when the present arc AC is compressed in both of the mutually opposing and butting steps, while the radius R of the arc-shaped portion 85 is set such that it is the same radius R as the inner peripheral radius of the semidivided cylindrical portion 79.

And, by setting the dimensions of the arc-shaped portion 85 in this manner, not only the position of the A point of the arc-shaped portion 85 can be determined but also the projecting dimension a of the arc-shaped portion 85 can be determined.

Here, a dimension a shown in FIG. 2 is the projecting dimension a of the arc-shaped portion 85, while a square inscribed to the escape hole 71 and having a width b is formed in a conventionally known hole shape.

In the method for manufacturing a pipe with a partition according to the present embodiment, as described above, the shape of the escape hole 71 formed in the cutting step is defined not only by the pair of vertical lines 75 extending at right angles to the longitudinal direction of the two mutually opposed connecting portions 73 with a gap between them but also by the pair of longitudinal-direction lines 77 connecting together the end points of the pair of vertical lines 75 on the same side thereof, while the distance between the pair of longitudinal-direction lines 77 is so set as to decrease as it approaches the middle points O of the longitudinal-direction lines 77. Therefore, when the semidivided partition portions 83 are formed in the compressing step, then the arc-shaped portions 85, which are respectively the edge portions of the semidivided partition portions 83 on the connecting portion 73 side thereof, are formed in such a manner that it is inclined from the leading end thereof toward the semidivided cylindrical portions 79. Due to this, in the butting step of the manner that they are inclined from their respective leading ends thereof toward the semidivided cylindrical portions 79, with the result that the gap formed between the semidivided partition portions 83 and connecting portion 13 can be reduced still further.

Also, according to the present embodiment, since each of the longitudinal-direction lines 77 is formed in an arc shape having the same radius R as the inner peripheral radius R of the semidivided cylindrical portions 79, when the semidivided partition portions 83 are formed in the compressing step, the edge portions of the semidivided partition portions 83 on the connecting portion 73 side thereof respectively provide the arc-shaped portions 85 which are inclined from their respective leading ends toward the semidivided cylindrical portions 79. Due to this, in the butting step of the semidivided cylindrical portions 79, the connecting portion 73 having the same radius as the semidivided cylindrical portions 79 can be easily formed along the arc-shaped portions 85 of the semidivided partition portions 83 on the connecting portion 73 side thereof.

By the way, in the above-mentioned embodiment, description has been given of an example in which the longitudinal-direction lines 77 of the escape hole 71 are respectively formed in an arc shape having the same radius R as the inner peripheral radius R of the semidivided cylindrical portions 79. However, the present invention is not limited to semidivided cylindrical portions 79, the connecting portion 73 is formed along the arc-shaped portions 85 which are the edge portions of the semidivided partition portions 83 on the connecting portion 73 side thereof, which makes it possible to greatly reduce the size of the gap formed between the semidivided partition portions 83 and the connecting portion 73 when compared with the conventional methods.

Also, in the method for manufacturing a pipe with a partition according to the present embodiment, since first and second lateral-direction lines forming the escape hole 71 are formed of the vertical lines 75 extending at right angles to the longitudinal direction of the connecting portion 73, in the mutually opposing step in which the connecting portion 73 is projected from the inside thereof and the pair of semidivided cylindrical portions 79 are thereby caused to be disposed opposed to each other, the portion in which the vertical lines 75 overlap each other can be bent positively.

Figure 6A:
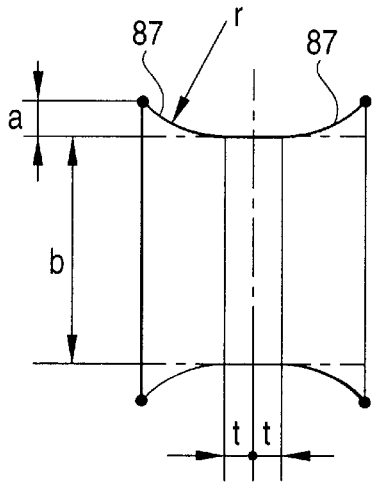
FIGS. 6A and 6B are explanatory views of other embodiments of the escape hole formed in the cutting step employed in a method for manufacturing a pipe with a partition according to the invention.

Further, in the method for manufacturing a pipe with a partition according to the present embodiment, since first and second longitudinal-direction lines .77 forming the escape hole 71 are formed symmetrically on both sides of the longitudinal-direction center line of the connecting portion 73, when the semidivided partition portions 83 are formed in the compressing step, then, the respective edge portions of the thus formed semidivided partition portions 83 respectively existing on the two sides of the connecting portion 73 are formed in such a this but, for example, as shown in FIG. 6A, the corresponding portions of the central portions of the longitudinal-direction lines 77 of the escape hole 71, which correspond to the plate thickness 2t of the semidivided partition portions 83, can also be formed as straight line portions and, on both sides of the straight line portions, arc-shaped portions 87 having a radius r can be formed respectively.

Also, the present arc-shaped portions 87 may also be formed of straight lines.

Figure 6B:
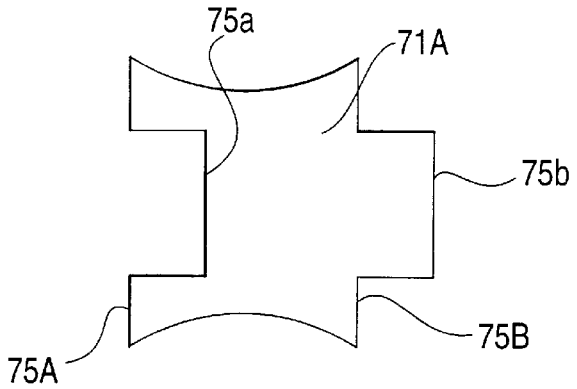

Further, in the above-mentioned embodiment, description has been given of an embodiments in which the first and second lateral-direction lines forming the escape hole 71 are formed of the pair of vertical lines 75 extending at right angles to the longitudinal direction of the connecting portion 73. However, the present invention is not limited to this but, for example, as shown in FIG. 6B, there can also be formed, in a first lateral-direction line 75A, a projection-shaped portion 75*a* which projects toward an escape hole 71A, while there can be formed, in a second lateral-direction line 75B, a recess-shaped portion 75*b* which has a shape corresponding to the shape of the projection-shaped portion 75*a*.

Furthermore, the first and second lateral-direction lines of the escape hole may also be formed in an arc shape, a triangular shape, or the like.

Still further, still other embodiment of a method for manufacturing a pipe with a partition will be described.

Figure 7:
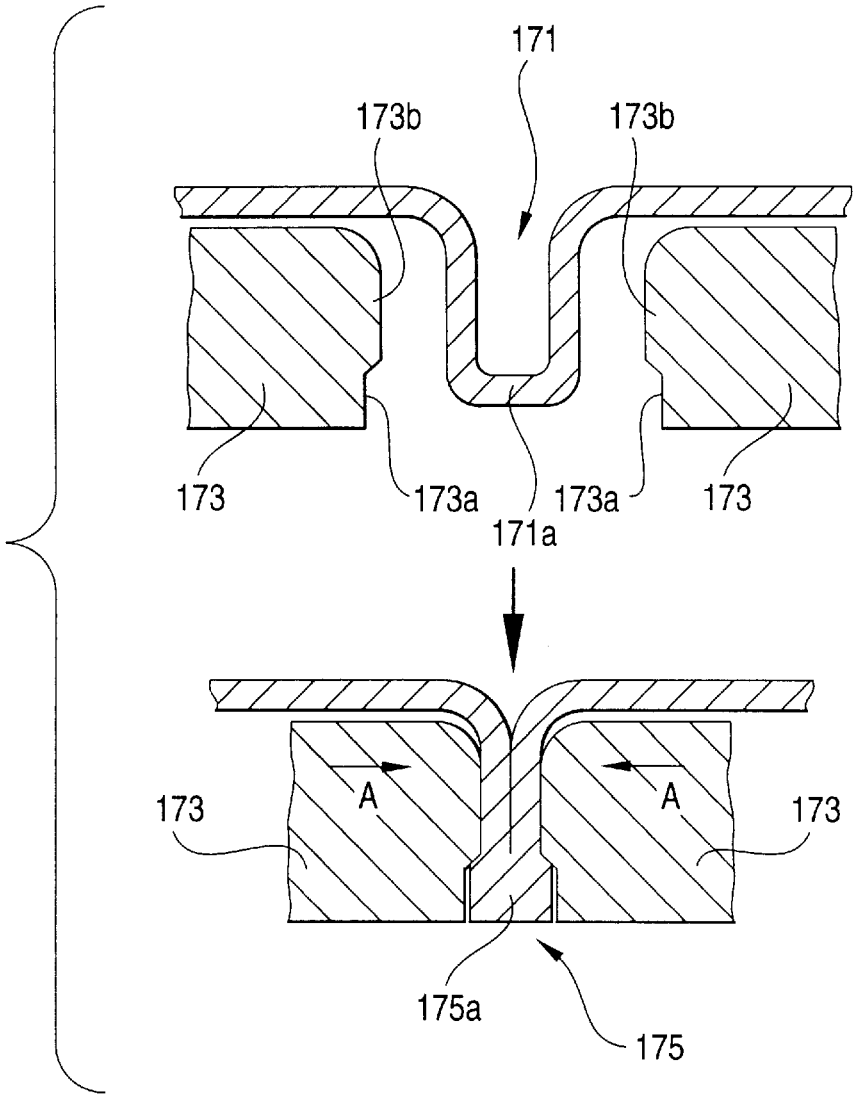
FIG. 7 is an explanatory view of an embodiment of a compressing step employed in a method for manufacturing a pipe with a partition according to the invention.

FIG. 7 shows a compressing step employed in a first embodiment of a method for manufacturing a pipe with a partition according to the invention. In the present embodiment, as shown in FIG. 7, a U-shaped partition forming portion 171 formed in a molding step is pressed by a pair of compressing members 173 which are respectively disposed on the two sides of the partition forming portion 171 in a direction of an arrow A, so that, as shown in FIG. 7, there is formed a semidivided partition portion 175.

And, in the present embodiment, each of the compressing members 173 includes a leading end working portion 173*a* for working the leading end portion 171*a* of the partition forming portion 171 and a projecting portion 173*b* for working the other portions of the partition forming portion 171 than the leading end portion 171*a* thereof.

Figure 8:
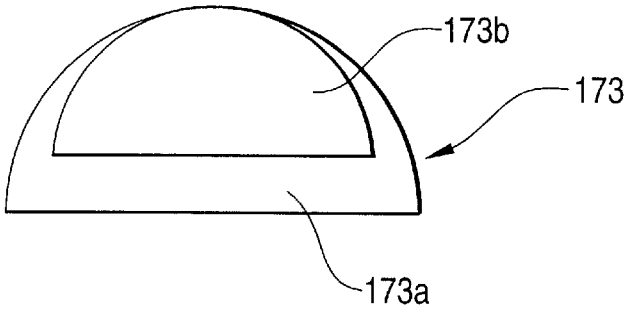
FIG. 8 is an enlarged front view of a projecting portion of the compressing member in FIG. 7.

The projecting portion 173*b*, as shown in FIG. 8, is formed in a semicircular shape so that the outer periphery of the projecting portion 173*b* can be inscribed to the end face of the semicircular compressing member 173, whereas the other to portions of the compressing member 173 than the projecting portion 173*b* are formed as the leading end working portion 173*a*.

In a method for manufacturing a pipe with a partition according to the present embodiment, the compression of the U-shaped partition forming portion 171 in the compressing step is carried out by pressing the pair of compressing members 173 against the partition forming portion 171. Here, the pair of compressing members 173 are respectively disposed on the two sides of the partition forming portion 171, while each of the compressing member: 173 includes, in the other portions of the partition forming portion 171 than the leading end portion 171*a* thereof, a projecting portion 173*b* projecting toward the partition forming portion 171. Due to this, the gap, which is produced in the other portions of the semidivided partition portion 175 than the leading end portion 175*a* thereof, can be narrowed and closely contacted.

Therefore, it is possible to surely prevent the gap from being produced in the semidivided partition portions 175, thereby being able to eliminate the fear of corrosion of the gap portion that is caused by invasion of liquid into the gap.

Now, FIG. 9 shows a compressing step employed in the other embodiment of a method for manufacturing a pipe with a partition according to the invention. In the present embodiment, at first, as shown in FIG. 9, the whole of the U-shaped partition forming portion 171, especially, the leading end portion 171*b* thereof is formed by a pair of first compressing members 177 the end faces of which are formed flat as a whole.

Next, a gap, which is produced in the other portions of the semidivided partition portion 175 than the leading end portion 175*a* thereof, is compressed and molded by a pair of second compressing members 173 which are the same as those used in the previously described first embodiment and respectively include the projecting portions 173 on the end faces thereof.

In a method for manufacturing a pipe with a partition according to the present embodiment, after the leading end portion 171*b* of the partition forming portion 171 is mainly compressed by the first compressing members 177, the other portions of the partition forming portion 171 than the leading end portion 171*a* thereof are mainly compressed by the second compressing members 173. Due to this, the gap, which is formed in the other portions of the semidivided partition portion 175 than the leading end portions 175*a* thereof, can be narrowed and closely contacted with more accuracy.

Now, FIG. 10 shows a compressing step employed in still the other embodiment of a method for manufacturing a pipe with a partition according to the invention. In the present embodiment, there are used a pair of compressing members 179: each compressing member 179 is structured such that a fixed compressing member 183 is movably inserted into a through hole 81*a* formed in a movable compressing member 181 in the axial direction thereof.

The fixed compressing member 183 is supported by a support member 185 and, between the support member 185 and movable compressing member 181, there is interposed an elastic member 187 which is formed of a plate spring or the like.

In the present embodiment, at first, as shown right in FIG. 10, the fixed compressing member 183 and movable compressing member 181 are pressed due to the pressure of the support member 185 so that the whole of the U-shaped partition forming portion 171, especially, the leading end portion 171*b* thereof is mainly molded.

And, if the pressure applied to the support member 185 increases, then, as shown left in FIG. 10, only the fixed compressing member 183 is moved due to the pressure of the support member 185, so that the gap formed in the other remaining portions of the semidivided partition portion 175 than the leading end portion 175*a* thereof is compressed and molded by the fixed compressing member 183.

In a method for manufacturing a pipe with a partition according to the present embodiment, after the leading end portion 171*b* of the partition forming portion 171 is mainly compressed by the movable compressing members 191, the other portions of the partition forming portion 171 than the leading end portion 171*a* thereof are mainly compressed by the fixed compressing members 183. Due to this, the gap, which is formed in the other portions of the semidivided partition portion 175 than the leading end portion 175*a* thereof, can be narrowed and closely contacted with more accuracy.

Figure 11:
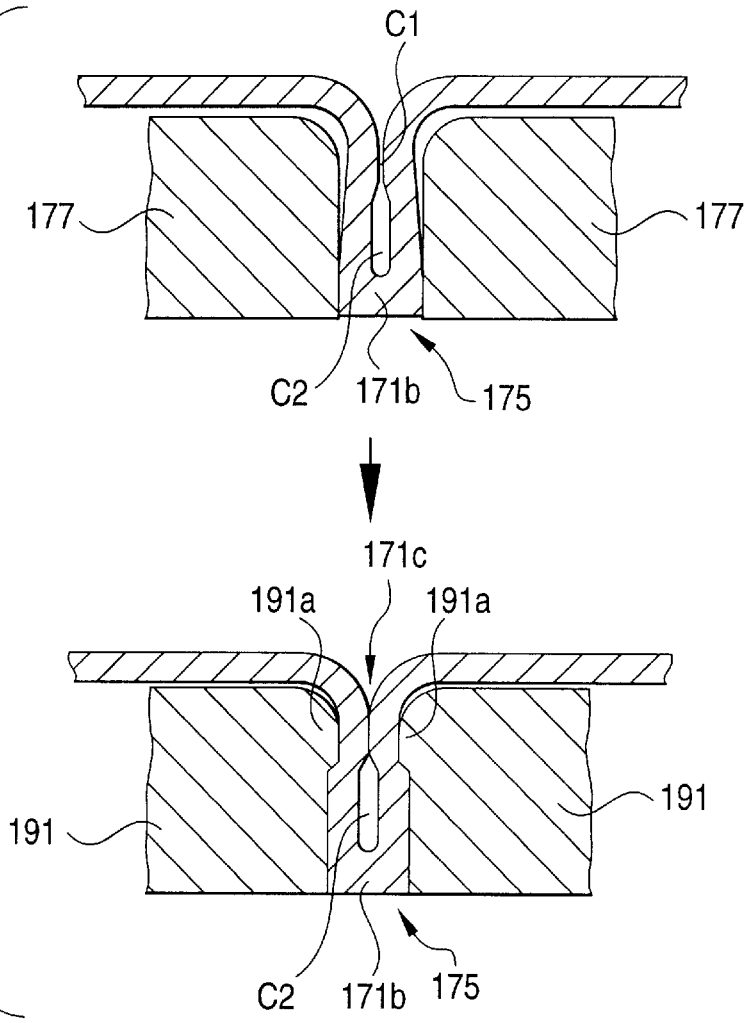
FIG. 11 is an explanatory view of still another embodiment of a compressing step employed in a method for manufacturing a pipe with a partition according to the invention.

Now, FIG. 11 shows a compressing step employed in a fourth embodiment of a method for manufacturing a pipe with a partition according to the invention. In the present embodiment, at first, as shown in FIG. 11, the whole of the U-shaped partition forming portion 171, especially, the leading end portion 171*b* thereof is molded by a pair of first compressing members 177 the end faces of which are formed flat as a whole.

And next, only the base portion 171*c* of the semidivided partition portion 175 is compressed and molded by a pair of second compressing members 191 each including a projecting portion 191*a*, so that a gap C1 formed in the bass portion 171*c* can be narrowed and closely contacted.

Figure 12:
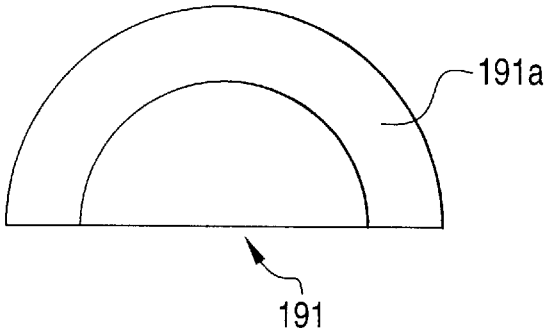
FIG. 12 is an enlarged front view of a projecting portion of the compressing member in FIG. 7.

By the way, the projecting portion 191*a*, as shown in FIG. 12, is formed in an annular shape which extends along the outer peripheral side of the end face of the semicircular compressing member 191.

In a method for manufacturing a pipe with a partition according to the present embodiment, since the compression of the U-shaped partition forming portion 171 in the compressing step is performed only on the root portion 171*c* of the partition forming portion 171, the gap C1 formed in the root portion 171*c* of the semidivided partition portion 175 can be narrowed and closely contacted with accuracy.

By the way, in the present embodiment, although there is left a gap C2 between the root portion 171*c* and leading end portion 171*b* of the semidivided partition portion 175, since the base portion 171*c* is brazed to thereby prevent liquid from invading into the gap C2, there is eliminated the fear of corrosion of the gap C2 portion.

Now, description will be given below of an embodiment of a method for manufacturing a header pipe with a partition according to the invention with reference to the accompanying drawings.

In the present embodiment, a header with a partition is manufactured using an aluminum flat plate.

The header with a partition is manufactured in the following manner.

Figure 13:
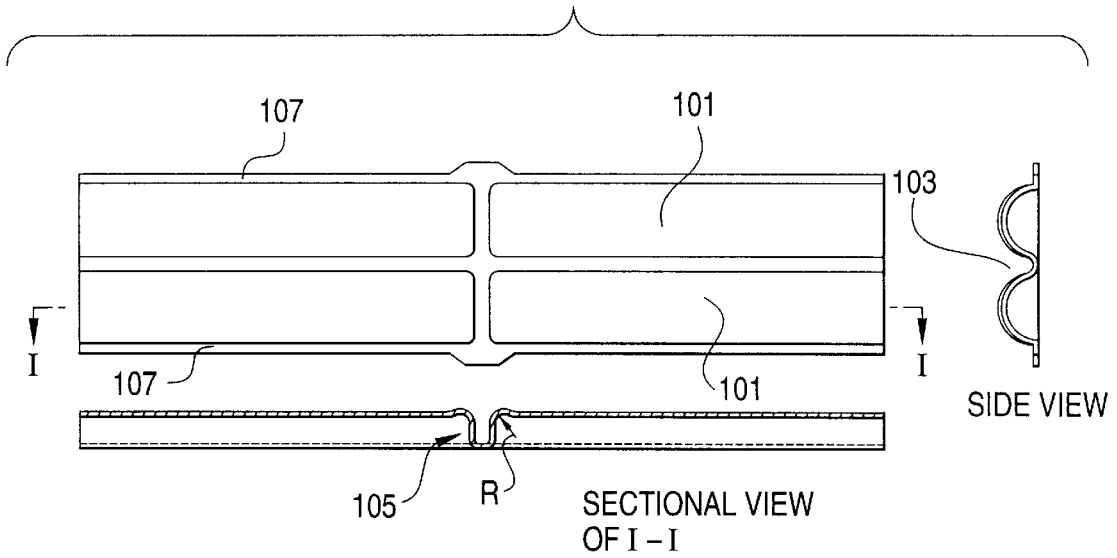
FIG. 13 is an explanatory view of the embodiment of a method for manufacturing a pipe with a partition according to the invention, showing a first molding step employed therein.

At first, in a molding step shown in FIG. 13, there is molded an aluminum plate member on both surfaces of which brazing material layers are respectively to be formed, and, in the thus molded aluminum plate member, there are formed a pair of semidivided cylindrical portions 101.

The pair of semidivided cylindrical portions 101 are arranged in parallel to each other with an arc-shaped connecting portion 103 between them.

And, in the pair of semidivided cylindrical portions 101, there are formed U-shaped partition forming portions 105 which respectively project inwardly.

On the respective outside portions of the pair of semidivided cylindrical portions 101, there are formed edge portions 107.

Figure 14:
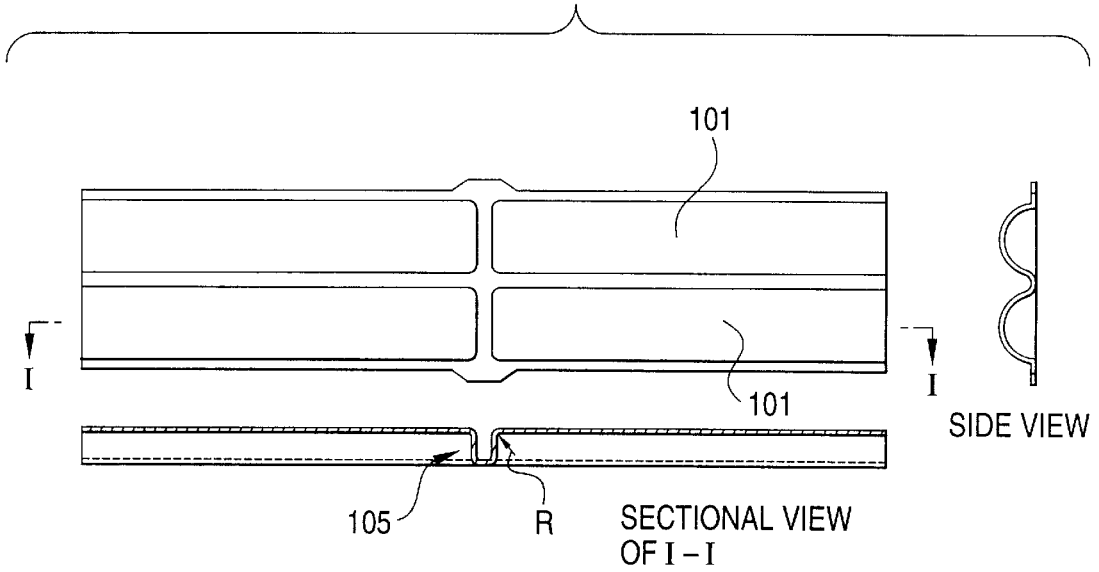
FIG. 14 is an explanatory view of the embodiment of a method for manufacturing a pipe with a partition according to the invention, showing a second molding step employed therein.

Next, in a second molding step shown in FIG. 14, the base portion of each of the partition forming portions 105 is molded into an arc shape having a given radius.

Figure 15:
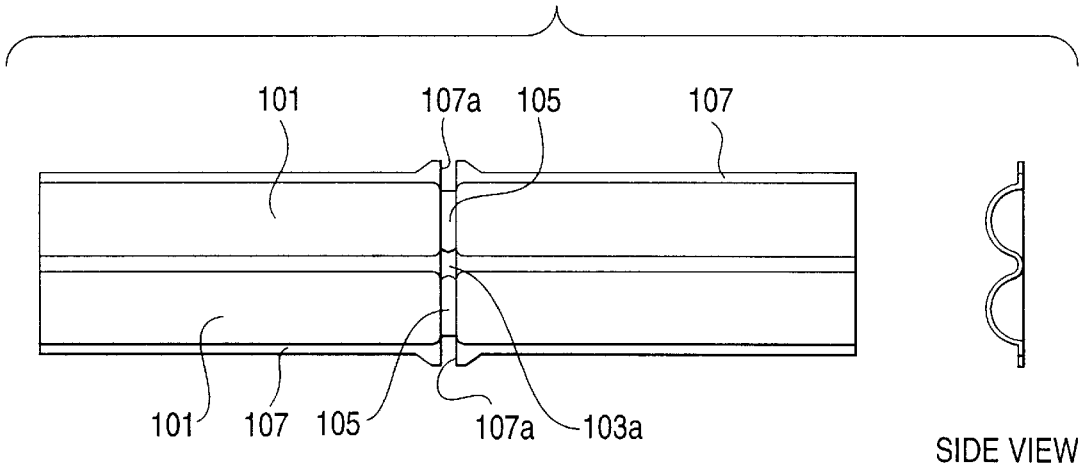
FIG. 15 is an explanatory view of the embodiment of a method for manufacturing a pipe with a partition according to the invention, showing a cutting step employed therein.

After then, in a cutting stop shown in FIG. 15, the connecting portion 103 interposed between the partition forming portions 105 as well as edge portions 107*a* respectively situated on the two sides of the partition forming portions 105 are cut and removed together with the excessively increased thickness portions of the edge portions 107.

This cutting step can be achieved by trimming and piercing the aluminum plate member using a press work machinery.

And, in the present embodiment, an escape hole 103*a* formed in the connecting portion 103 interposed between the partition forming portions 105 is formed in such a manner that it has the same shape as the shape of the connecting portion formed in the previously described embodiment and shown in FIG. 2.

Figure 16:
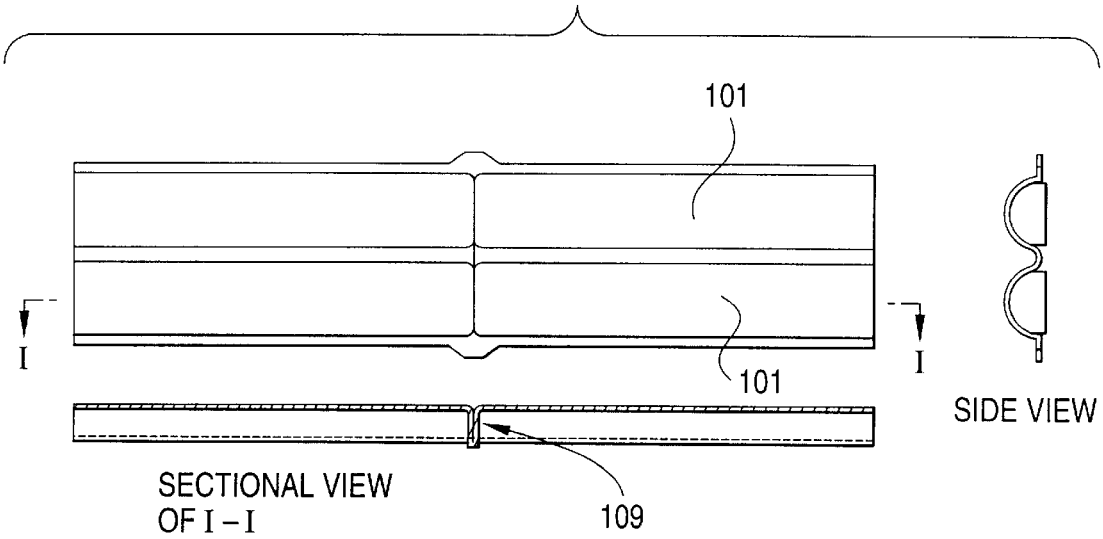
FIG. 16 is an explanatory view of the embodiment of a method for manufacturing a pipe with a partition according to the invention, showing a compressing step employed therein.

After then, in a compressing step shown in FIG. 16, the partition forming portions 105 are respectively compressed from the two sides thereof to thereby produce a semidivided partition portion 109.

The compressing step is carried out by using a pair of compressing members 173 (177 and 173, 179, or 177 and 191) employed in the previously described embodiments.

Figure 17:
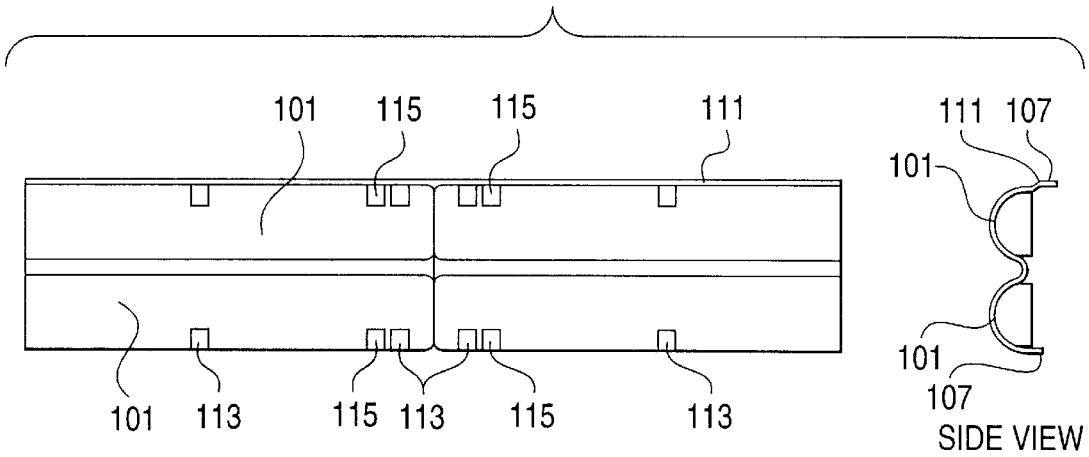
FIG. 17 is an explanatory view of the embodiment of a method for manufacturing a pipe with a partition according to the invention, showing an edge portion molding step employed therein.

Next, in an edge portion molding step shown in FIG. 17, the edge portions 107 of the pair of semidivided cylindrical portions 101, which are respectively located on the two sides of the semidivided cylindrical portions 101, are respectively molded; that is, each of the edge portions 107 is molded into an arc shape which continues with its associated semidivided cylindrical portion 101.

Also, in the edge portion 107 in which a caulking pawl portion (which will be discussed later) is to be formed, there is provided a stepped portion 111 and, at the same time, not only securing recessed portions 113 for caulking and fixing the caulking pawl portion but also pressing recessed portions 115 are worked by embossing.

This edge portion molding step is carried out by holding the pair of semidivided cylindrical portions 101 between given metal molds and then working them by pressing.

Figure 18:
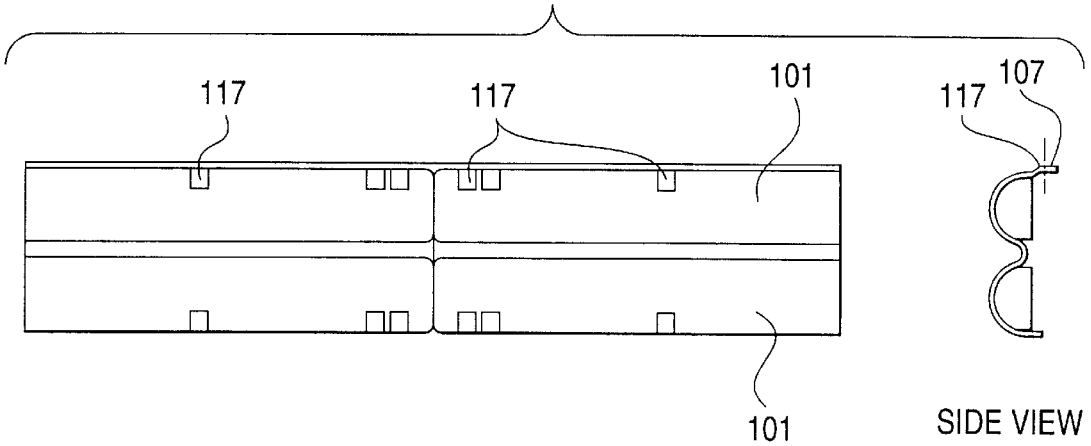
FIG. 18 is an explanatory view of the embodiment of a method for manufacturing a pipe with a partition according to the invention, showing a second cutting step employed therein.

After then, in a second cutting step shown in FIG. 18, the unnecessary portions of the edge portions 107 except for the portions thereof which are to be formed as caulking pawl portions 117 are worked by trimming, thereby forming the caulking pawl portions 117.

Figure 19:
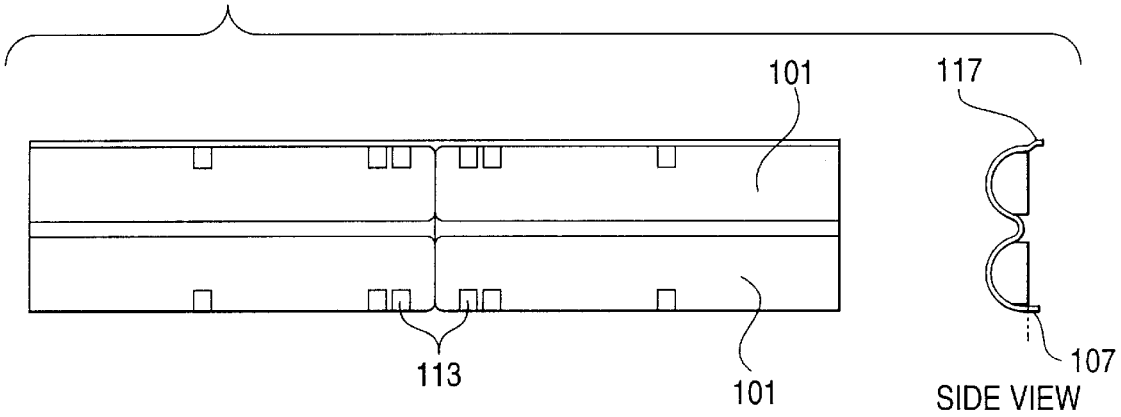
FIG. 19 is an explanatory view of the embodiment of a method for manufacturing a pipe with a partition according to the invention, showing a third cutting step employed therein.

Next, in a third cutting step shown in FIG. 19, the unnecessary portions of the edge portion 107 located on the securing recessed portion 113 side are cut and removed by trimming.

Figure 20:
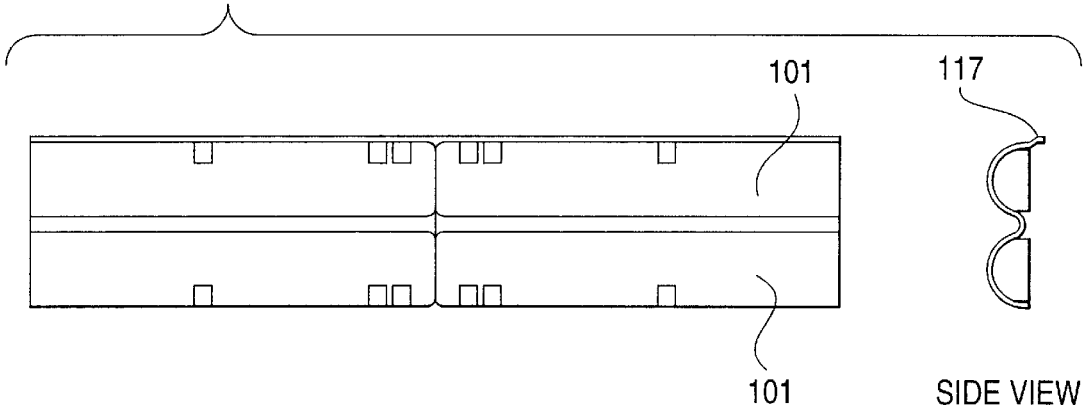
FIG. 20 is an explanatory view of the embodiment of a method for manufacturing a pipe with a partition according to the invention, showing a restriking step employed therein.

After then, in a restriking step shown in FIG. 20, the caulking pawl portions 117 are restruck so that they form right angles.

Figure 21:
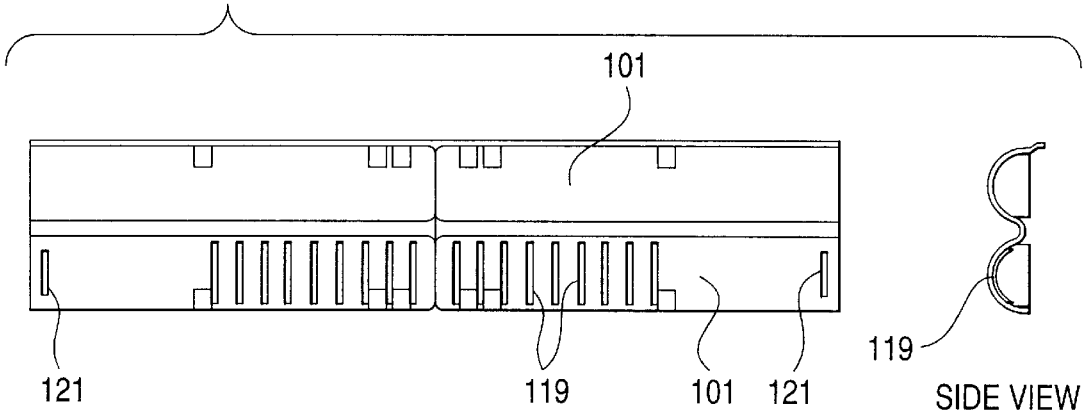
FIG. 21 is an explanatory view of the embodiment of a method for manufacturing a pipe with a partition according to the invention, showing a first tube insertion hole forming step employed therein.

Next, in a first tube insertion hole forming step shown in FIG. 21, in the central portion of one of the paired semidivided cylindrical portions 101, there are formed a plurality of tube insertion holes 119 spaced at given intervals and, on the two sides of the present semidivided cylindrical portion 101, there are formed two side plate insertion holes 121.

The first tube insertion hole forming step can be achieved by slit/pierce molding the aluminum plate member using a press work machinery.

Figure 22:
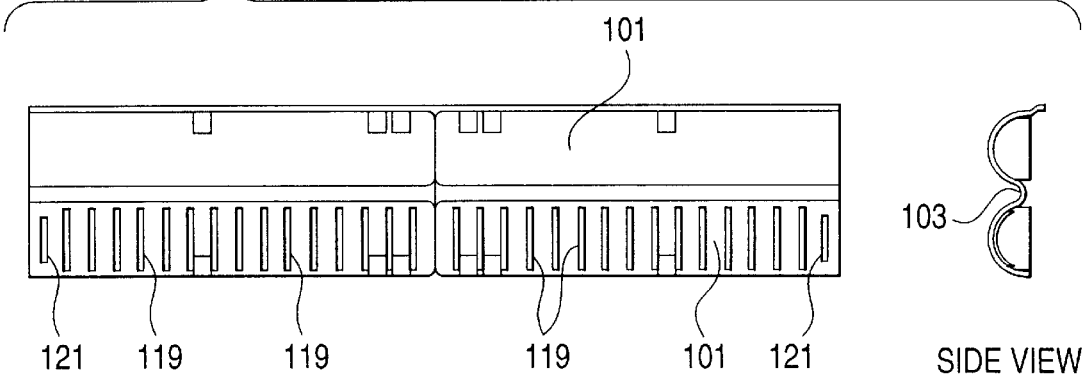
FIG. 22 is an explanatory view of the embodiment of a method for manufacturing a pipe with a partition according to the invention, showing a second tube insertion hole forming step employed therein.

Next, in a second tube insertion hole forming step shown in FIG. 22, on the two sides of the tube insertion holes 119 formed in the central portion of one of the paired semidivided cylindrical portions 101, there are further formed a plurality of tube insertion holes 119 in such a manner that they are spaced at given intervals from one another.

The second tube insertion hole forming step can be achieved by slit/pierce molding the aluminum plate member using a press work machinery.

Figure 23:
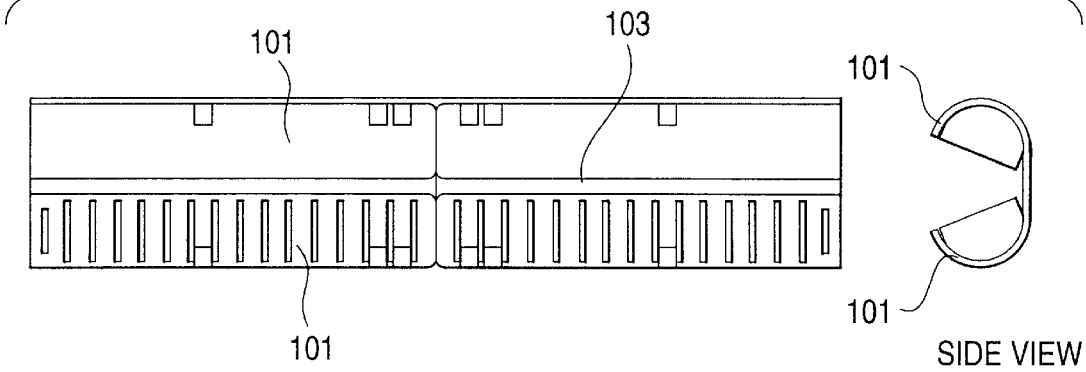
FIG. 23 is an explanatory view of the embodiment of a method for manufacturing a pipe with a partition according to the invention, showing a mutually opposing step employed therein.

After then, in a mutually opposing step shown in FIG. 23, the connecting portion 103 is projected from the inside thereof, so that the pair of semidivided cylindrical portions 101 are disposed opposed to each other.

Figure 24:
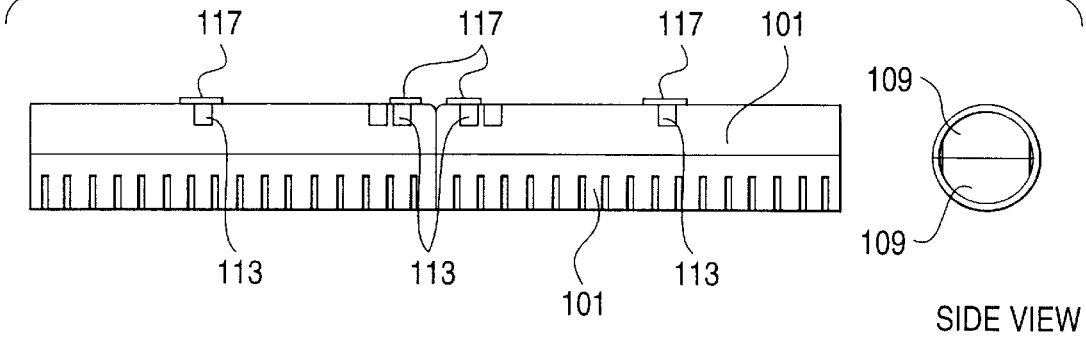
FIG. 24 is an explanatory view of the embodiment of a method for manufacturing a pipe with a partition according to the invention, showing a butting step employed therein.
Figure 25:
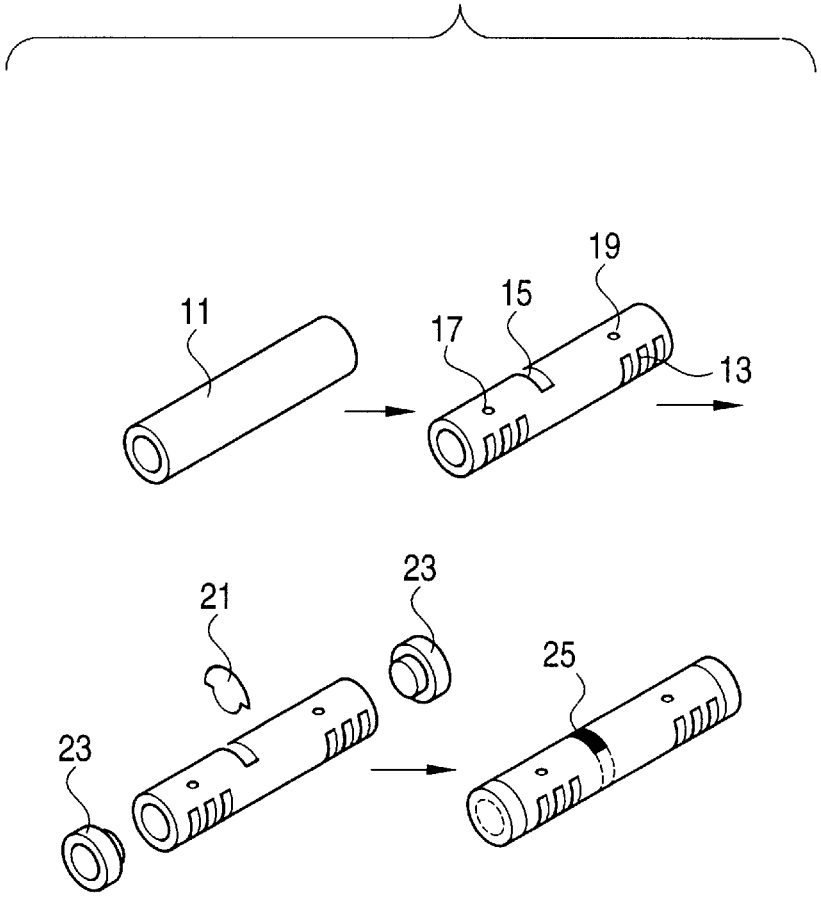
FIG. 25 PRIOR ART
FIG. 25 is an explanatory view of a conventional method for manufacturing a pipe with a partition.
Figure 26:
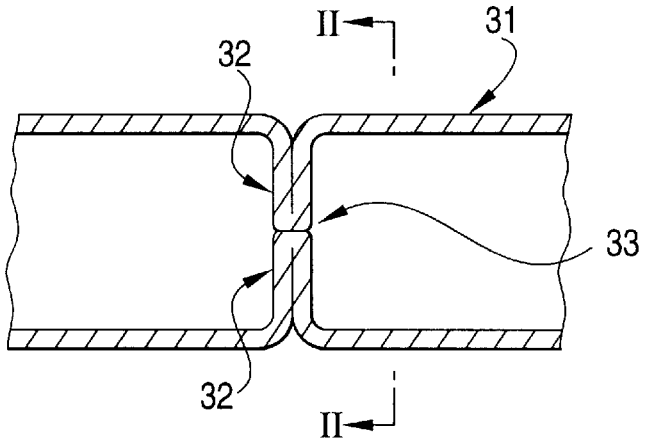
FIG. 26 PRIOR ART
FIG. 26 is a section view of a pipe with a partition manufactured according to the conventional method for manufacturing a pipe with a partition.
Figure 27:
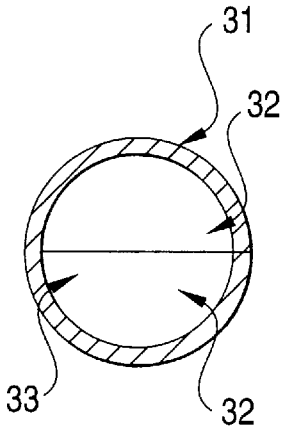
FIG. 27 PRIOR ART
FIG. 27 is a section view taken along the line II—II in FIG. 26.
Figure 28:
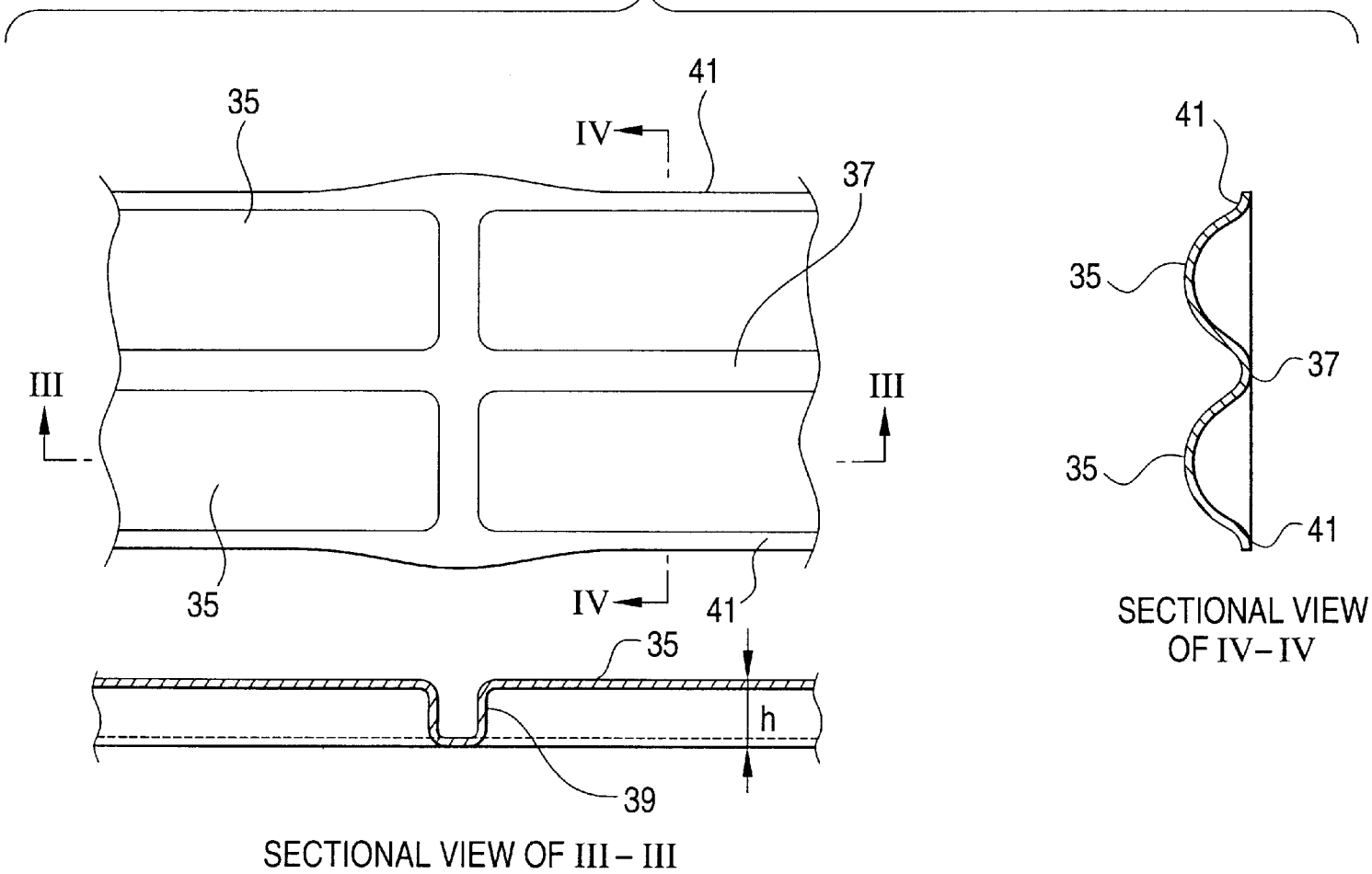
FIG. 28 PRIOR ART
FIG. 28 is an explanatory view of a molding step employed in the conventional method.
Figure 29:
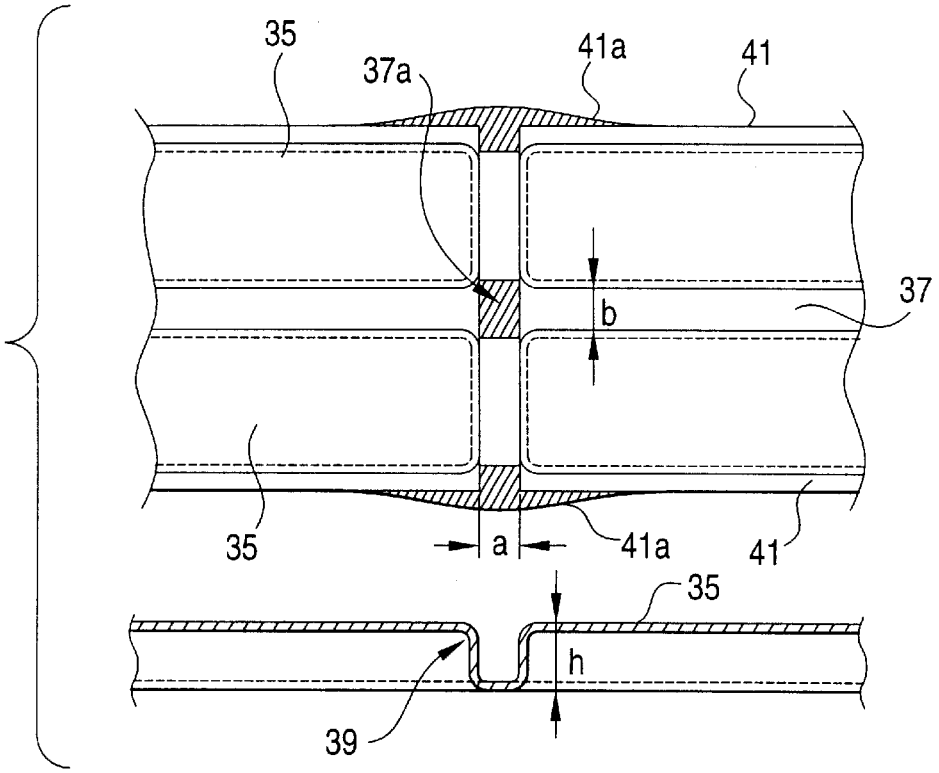
FIG. 29 PRIOR ART
FIG. 29 is an explanatory view of a cutting step employed in the conventional method.
Figure 30:
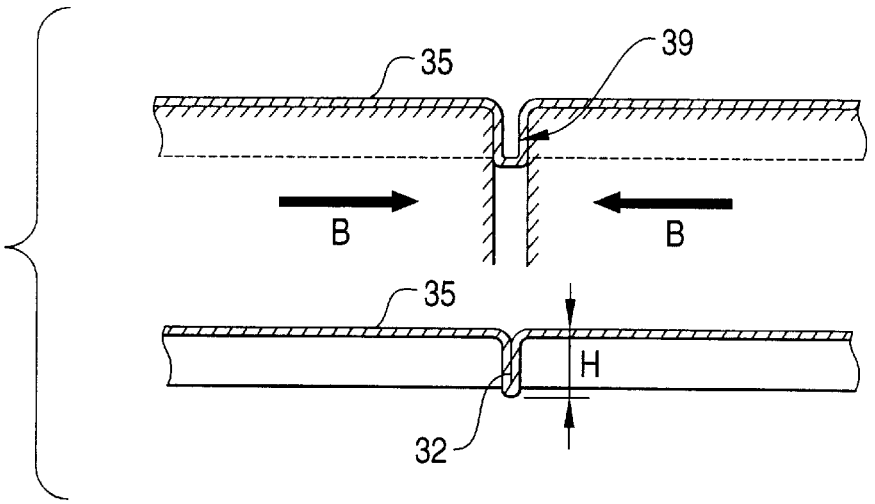
FIG. 30 PRIOR ART
FIG. 30 is an explanatory view of a compressing step employed in the conventional method.
Figure 31:
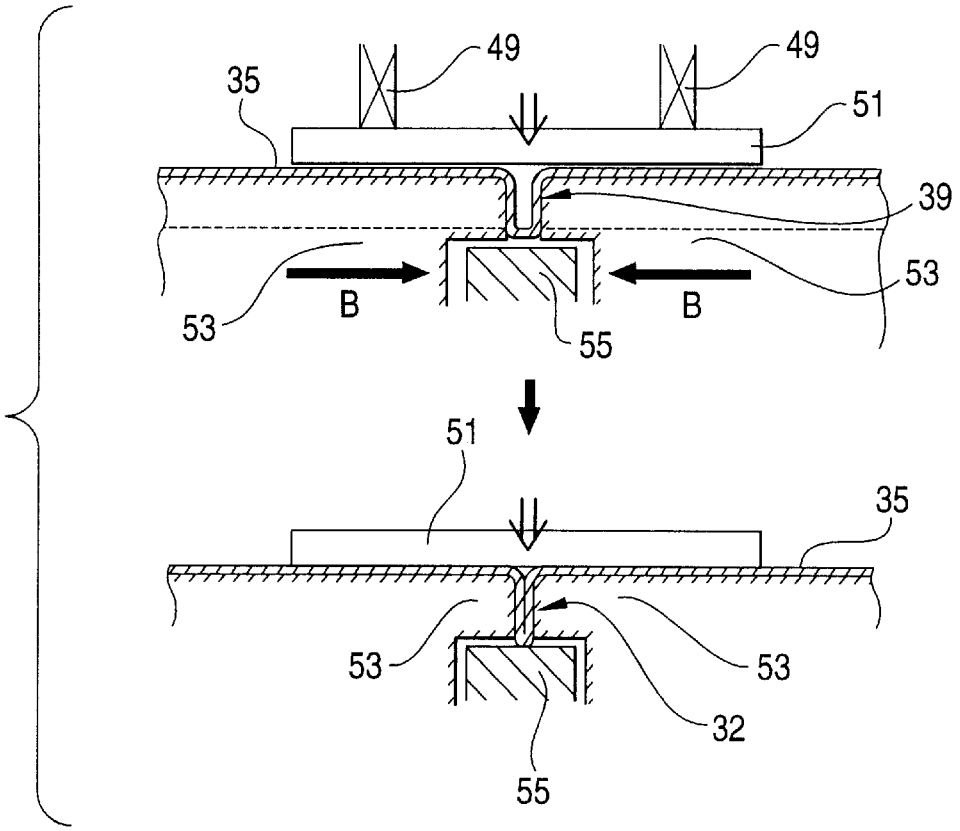
FIG. 31 PRIOR ART
FIG. 31 is an explanatory view of the compressing step shown in FIG. 30, showing how the-compressing step is carried out.
Figure 32:
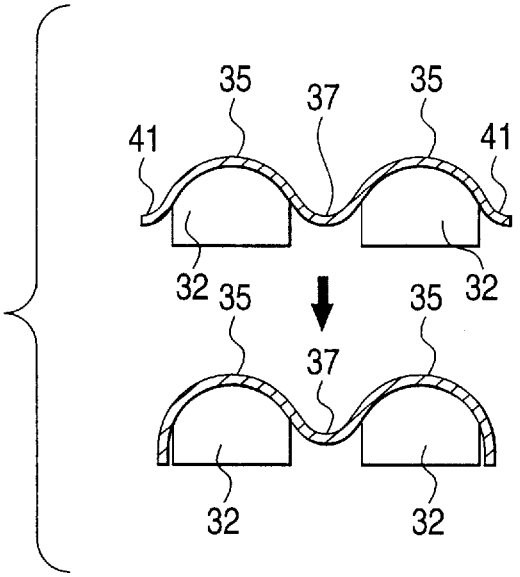
FIG. 32 PRIOR ART
FIG. 32 is an explanatory view of an edge portion molding step employed in the conventional method.
Figure 33:
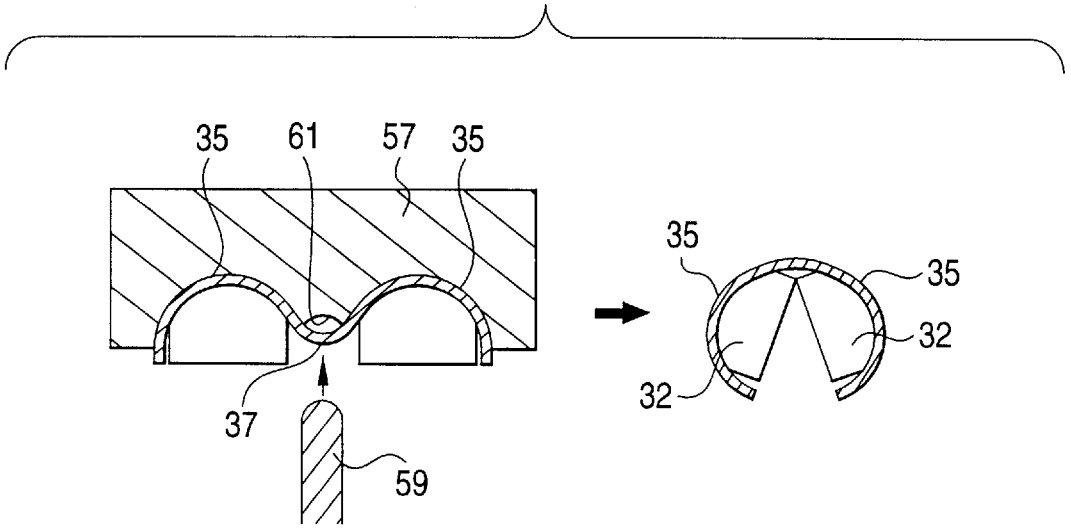
FIG. 33 PRIOR ART
FIG. 33 is an explanatory view of a mutually opposing step employed in the conventional method.
Figure 34:
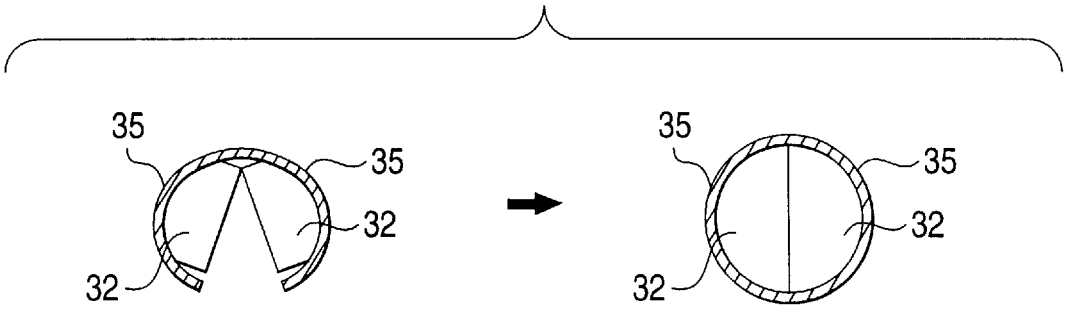
FIG. 34 PRIOR ART
FIG. 34 is an explanatory view of a butting step employed in the conventional method.
Figure 35:
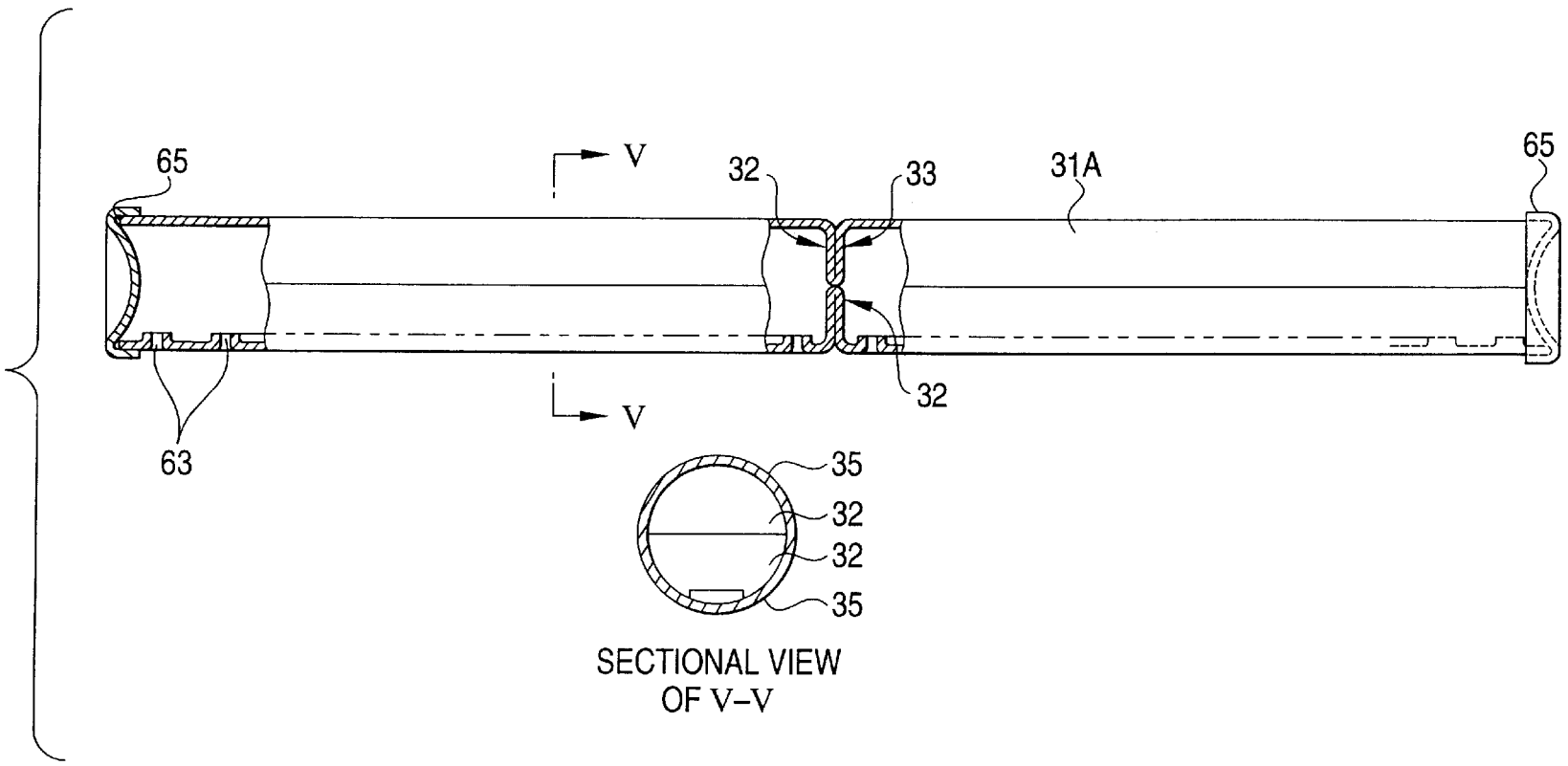
FIG. 35 PRIOR ART
FIG. 35 is a side view of a conventional header pipe with a partition in which a tube insertion hole is formed.
Figure 36:
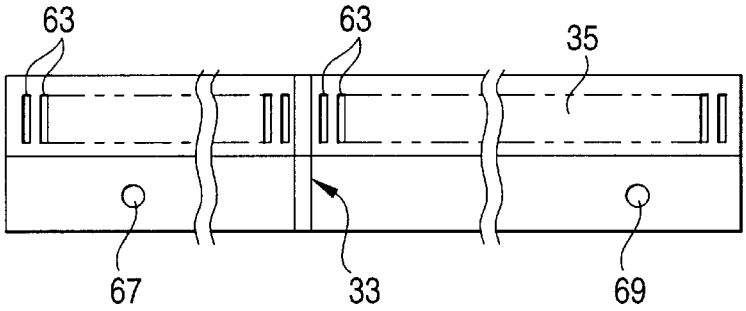
FIG. 36 PRIOR ART
FIG. 36 is an explanatory view of a tube insertion hole forming step employed in the conventional method.
Figure 37:
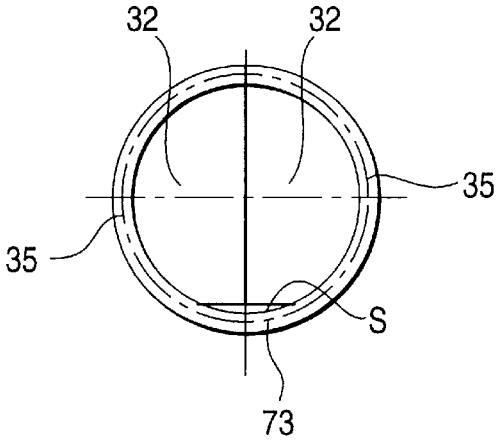
FIG. 37 is an explanatory view of the conventional method for manufacturing a pipe with a partition, showing a state thereof after the butting step is carried out.
Figure 38:
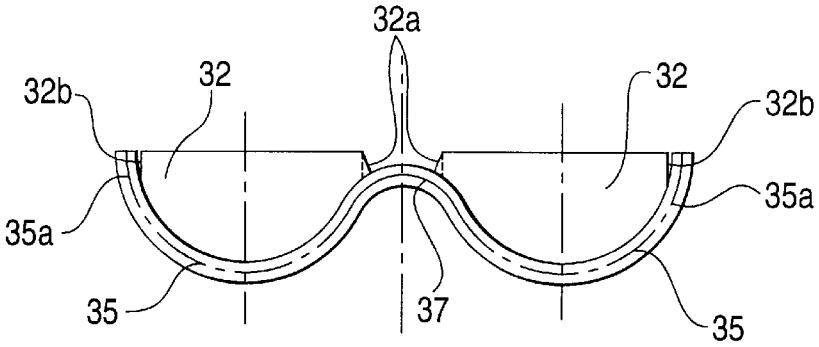
FIG. 38 is an explanatory view of the conventional method for manufacturing a pipe with a partition, showing a state of the semidivided partition portions after the compressing step is carried out.
Figure 39:
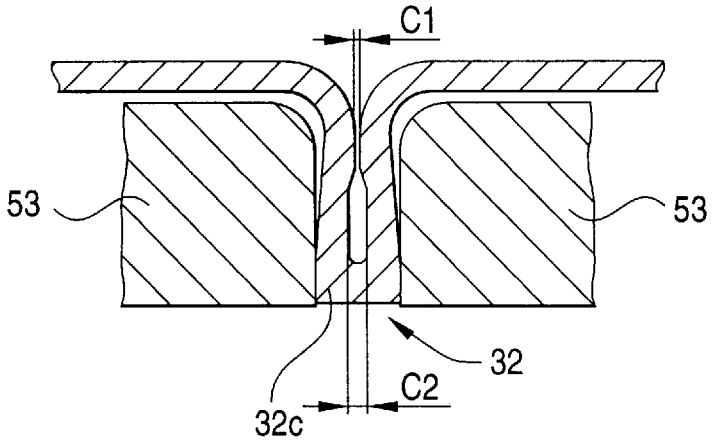
FIG. 39 is an explanatory view of a compressing step employed in the conventional method.

Next, in a butting step shown in FIG. 24, the pair of mutually opposed semidivided cylindrical portions 101 are butted against each other.

After then, in a caulking step (which in not shown), the caulking pawl portions 117 are caulked and fixed to the securing recessed portions 113. In this state, a connecting step is executed so that not only the pair of semidivided cylindrical portions 101 but also the pair of semidivided partition portions 109 are connected to each other.

By the way, according to the present embodiment, the connecting step is carried out by executing a brazing operation using non-corrosive flux.

In the header pipe with a partition manufactured in the above-mentioned manner, since the shape of the escape hole 103*a* in the cutting step is formed in the same shape as the escape hole 71 in the previously described embodiment, in the butting step of the semidivided cylindrical portions 101, the connecting portion 103 can be molded along the edge portion of the semidivided partition portion 109 arranged on the connecting portion 103 side. This makes it possible to reduce greatly the size of the gap formed between the semidivided partition portion 109 and connecting portion 103 when compared with the conventional methods, so that the semidivided partition portions 109 and connecting portion 103 can be positively brazed to each other.

Further, the compression of the U-shaped partition forming portion 105 in the compressing step is carried out by pressing the pair of compressing members against the partition forming portion 105. Here, the pair of compressing members are respectively disposed on the two sides of the partition forming portion 105. Each of the compressing members includes a projecting portion projecting toward the partition forming portion 105 in the other portions of the partition forming portion 105 than the leading end portion thereof. Due to this, the gap, which is formed in the other portions of the semidivided partition portion 109 than the leading end portion thereof, can be narrowed and closely contacted with ease and accuracy.

Therefore, it is possible to surely prevent the gap from being produced in the semidivided partition portion 109, thereby being able to eliminate the fear of corrosion of the gap portion that is caused by invasion of liquid into the gap.

As has been described heretofore, according to a method for manufacturing a pipe with a partition in the present invention, the shape of an escape hole formed in the cutting step is defined not only by the first and second lateral-direction lines opposed to each other with a gap between them and crossing the connecting portions but also by the first and second longitudinal-direction lines connecting together the end points of the first and second lateral-direction lines on the same side thereof; and, the distance between the first and second longitudinal-direction lines decreases toward the centers of the longitudinal-direction lines. Therefore, when the semidivided partition portions are formed according to the compressing step, the edge portions of the semidivided partition portions on the connecting portion side thereof are formed in such a manner that they are inclined from the leading ends thereof toward the semidivided cylindrical portions. Due to this, in the butting step of the semidivided cylindrical portions, the connecting portion can be formed along the edge portions of the semidivided partition portions on the connecting portion side thereof, which makes it possible to reduce greatly the size of the gap formed between the semidivided partition portions and the connecting portion when compared with the conventional partitioned pipe manufacturing methods.

And also, since the first and second lateral-direction lines are set in such a manner that they extend at right angles to the longitudinal direction the connecting portion, in the mutually opposing step in which the connecting portion is projected from the inside thereof to thereby cause the pair of semidivided cylindrical portions to be disposed in such a manner that they are opposed to each other, the portion in which the first and second lateral-direction lines overlap each other can be bent positively, Further, since the first and second lateral-direction lines are formed respectively on the two sides of the longitudinal-direction center line of the connecting portion in such a manner that they are symmetrical with respect to the present center line, when the semidivided partition portions are formed according to the compressing step, the semidivided partition portions existing on the two sides of the connecting portion, in particular, the edge portions thereof on the connecting portion side thereof are formed in such a manner that they are inclined from the leading ends thereof toward the semidivided cylindrical portions, thereby being able to further reduce the gap formed between the semidivided partition portions and the connecting portion.

Still further, since each of the longitudinal-direction lines is formed in an arc shape having the same radius as the inner peripheral radius of the semidivided cylindrical portion, when the semidivided partition portions are formed according to the compressing step, each of the edge portions of the semidivided partition portions on the connecting portion side thereof is formed in an arc shape which is inclined from the leading end thereof toward the semidivided cylindrical portion. Due to this, in the butting step of the semidivided cylindrical portions, the connecting portion having the same radius as the semidivided cylindrical portion can be formed easily along the edge portions of the semidivided partition portions on the connecting portion side thereof.

Further, the compression of the U-shaped partition forming portion in the compressing step is carried out in such a manner that the compression and deformation amounts of the no other portions of the U-shaped partition forming portion than the leading end portion thereof are larger than that of the leading end portion. Due to this, a gap, which is produced in the other portions of the semidivided partition portion than the leading end portion thereof, can be narrowed and closely contacted, which makes it possible to surely prevent the gap from being produced in the semidivided partition portion.

The compression of the U-shaped partition forming portion in the compressing step is carried out by pressing the pair of compressing members against the partition forming portion. Here, the pair of compressing members are respectively disposed on the two sides of the partition forming portion and also each of the compressing members includes a projecting portion projecting toward the partition forming portion in the other remaining portions of the partition forming portion than the leading end portion thereof. Due to this, the gap, which is produced in the other remaining portions of the semidivided partition portion than the leading end portion thereof, can be narrowed and closely contacted with ease.

Further, the compression of the U-shaped partition forming portion in the compressing step is carried out in such a manner that the leading end portion of the partition forming portion is firstly compressed and, after then, the other portions of the partition forming portion than the leading end portion thereof are compressed. Due to this, the gap, which is produced in the other remaining portions of the semidivided partition portion than the leading end portion thereof, can be narrowed and closely contacted with more accuracy.

Still further, the compression of the U-shaped partition forming portion in the compressing step is carried out in such a manner that the whole of the partition forming portion is firstly pressed and, after then, only the root portion of the partition forming portion is compressed. Due to this, a gap, which is produced in the root portion of the semidivided partition portion, can be narrowed and closely connected with accuracy.

What is claimed is:

1. A method for manufacturing a pipe with a partition, comprising the steps of:

molding a flat plate so that a pair of semi-cylindrical portions are arranged in parallel to each other through a connecting portion and a pair of U-shaped partition forming portions are respectively formed in said pair of semi-cylindrical portions so as to project inwardly thereof;

cutting at least a part of said connecting portion situated between said partition forming portions to thereby form an escape hole of which shape is defined by first and second lateral-direction lines opposed to each other with a gap between them and crossing said connecting portions and first and second longitudinal-direction lines connecting together end points of said first and second lateral-direction lines on the same side thereof, and a distance between said first and second longitudinal-direction lines decreases toward centers of said longitudinal-direction lines;

compressing said partition forming portions respectively from both sides thereof to thereby form substantially semi-circular partition portions;

folding said semi-cylindrical portions about said connecting portion to thereby dispose said semi-cylindrical portions so that they are opposed to each other;

butting said mutually opposed, semi-cylindrical portions against each other; and connecting said semi-cylindrical portions to each other so as to manufacture a pipe with a partition.

2. The method for manufacturing a pipe with a partition according to claim 1, wherein said first and second lateral-direction lines are formed extending at right angles to a longitudinal direction of said connecting portion.

3. The method for manufacturing a pipe with a partition according to claim 1, wherein said first and second longitudinal-direction lines are symmetrically formed on two sides of a longitudinal-direction center line of said connecting portion.

4. The method for manufacturing a pipe with a partition according to claim 1, wherein at least one of said first and second longitudinal-direction lines is formed in an arc shape having the same radius as an inner peripheral radius of said semi-cylindrical portions.

5. The method for manufacturing a pipe with a partition according to claim 1, wherein central portions of said first and second longitudinal-direction lines are formed as straight lines in a length corresponding to a predetermined thickness of said substantially semi-circular partition portions, both sides of the central portions are formed in an arc shape having the same radius as an inner peripheral radius of said semi-cylindrical portions.

6. The method for manufacturing a pipe with a partition according to claim 1, wherein said first lateral-direction line is formed so as to have a projection-shaped portion which projects toward the escape hole, and said second lateral-direction line is formed so as to have a recess-shaped portion which has a shape corresponding to a shape of the projection-shaped portion.

7. A method for manufacturing a pipe with a partition, comprising the steps of:

molding a flat plate so that a pair of semi-cylindrical portions are arranged in parallel to each other through a connecting portion and a pair U-shaped partition forming portions are respectively so formed in said pair of semi-cylindrical portions so as to project inwardly thereof;

compressing said partition forming portions respectively from both sides thereof so that leading end portions of said partition forming portions are compressed to a lesser degree than remaining portions of said partition forming portions, to thereby form substantially semi-circular partition portions;

folding said semi-cylindrical portions about said connecting portion to thereby dispose said semi-cylindrical portions so that they are opposed to each other;

butting said mutually opposed, semi-cylindrical portions against each other; and connecting said semi-cylindrical portions to each other so as to manufacture a pipe with a partition.

8. The method for manufacturing a pipe with a partition according to claim 7, further comprising the step of cutting at least a part of said connecting portion situated between said partition forming portions so as to remove the part.

9. The method for manufacturing a pipe with a partition according to claim 7, wherein said compressing step comprises the steps of:

disposing a pair of compressing members respectively on two sides of said partition forming portion, each of said pair of compressing members including a projecting portion projecting toward said partition forming portion except in a portion corresponding to said leading end portion of said partition forming portion; and pressing said pair of compressing members against said partition forming portions.

10. The method for manufacturing a pipe with a partition according to claim 9, further comprising the step of compressing a whole of said partition forming portion before disposing said pair of compressing members.

11. The method for manufacturing a pipe with a partition according to claim 7, wherein said compressing step comprises the steps of:

firstly compressing the leading end portion of the partition forming portion; and compressing the other portions of said partition forming portion than said leading end portion.

12. A method for manufacturing a pipe with a partition, comprising the steps of:

molding a flat plate so that a pair of semi-cylindrical portions are arranged in parallel to each other through a connecting portion and a pair of U-shaped partition forming portions are respectively so formed in said pair of semi-cylindrical portions so as to project inwardly thereof;

firstly compressing a whole of said partition forming portions respectively from both sides thereof;

compressing a base portion of said partition forming portion from both sides thereof to thereby form substantially semi-circular partition portions;

folding said semi-cylindrical portions about said connecting portion to thereby dispose said semi-cylindrical portions so that they are opposed to each other;

butting said mutually opposed, semi-cylindrical portions against each other; and connecting said semi-cylindrical portions to each other so as to manufacture a pipe with a partition.

* * * * *